US009563140B2

(12) United States Patent
Nozaki et al.

(10) Patent No.: US 9,563,140 B2
(45) Date of Patent: Feb. 7, 2017

(54) TONER

(71) Applicants: Tsuyoshi Nozaki, Osaka (JP); Takuya Kadota, Hyogo (JP); Yoshihiro Mikuriya, Hyogo (JP); Yoshimichi Ishikawa, Hyogo (JP); Kazuoki Fuwa, Hyogo (JP); Tomohiro Fukao, Osaka (JP); Tomoharu Miki, Osaka (JP)

(72) Inventors: Tsuyoshi Nozaki, Osaka (JP); Takuya Kadota, Hyogo (JP); Yoshihiro Mikuriya, Hyogo (JP); Yoshimichi Ishikawa, Hyogo (JP); Kazuoki Fuwa, Hyogo (JP); Tomohiro Fukao, Osaka (JP); Tomoharu Miki, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 77 days.

(21) Appl. No.: 14/060,800

(22) Filed: Oct. 23, 2013

(65) Prior Publication Data

US 2014/0147780 A1 May 29, 2014

(30) Foreign Application Priority Data

Nov. 29, 2012 (JP) ..... 2012-260831

(51) Int. Cl.
*G03G 9/093* (2006.01)
*G03G 9/087* (2006.01)
*G03G 9/08* (2006.01)

(52) U.S. Cl.
CPC ..... *G03G 9/0804* (2013.01); *G03G 9/0825* (2013.01); *G03G 9/08755* (2013.01); *G03G 9/08782* (2013.01); *G03G 9/08795* (2013.01); *G03G 9/08797* (2013.01); *G03G 9/09321* (2013.01); *G03G 9/09371* (2013.01); *G03G 9/09378* (2013.01); *G03G 9/09392* (2013.01)

(58) Field of Classification Search
CPC ..... G03G 9/09378; G03G 9/08782; G03G 9/0825; G03G 9/0821; G03G 9/08797; G03G 9/09321; G03G 9/09371; G03G 9/09392; G03G 9/0804
USPC ..... 430/108.4, 110.1, 110.2
See application file for complete search history.

(56) References Cited

U.S. PATENT DOCUMENTS

2006/0045571 A1* 3/2006 Matsuura et al. ..... 399/149
2006/0204882 A1 9/2006 Nozaki et al.
2006/0210902 A1 9/2006 Nakamura et al.
2006/0275686 A1 12/2006 Kadota et al.
2006/0292474 A1 12/2006 Mikuriya et al.
2007/0026335 A1 2/2007 Yamamoto et al.
2007/0059625 A1 3/2007 Yamamoto et al.
2007/0122729 A1 5/2007 Katoh et al.
2007/0148568 A1 6/2007 Kadota et al.
2007/0166635 A1 7/2007 Yamamoto et al.
2007/0190442 A1 8/2007 Nakamura et al.
2007/0190443 A1 8/2007 Hagi et al.
2007/0207399 A1 9/2007 Kadota et al.
2007/0212630 A1 9/2007 Yasunaga et al.
2007/0217842 A1 9/2007 Kato et al.
2007/0218384 A1 9/2007 Matsumoto et al.
2007/0218388 A1 9/2007 Kurose et al.
2007/0218390 A1 9/2007 Nozaki et al.
2007/0218393 A1 9/2007 Nozaki et al.
2007/0238042 A1 10/2007 Yasunaga et al.
2008/0032223 A1 2/2008 Yamamoto et al.
2008/0038656 A1 2/2008 Yasunaga et al.
2008/0063957 A1 3/2008 Murakami et al.
2008/0069598 A1 3/2008 Murakami et al.
2008/0069605 A1 3/2008 Fuwa et al.
2008/0069608 A1 3/2008 Katoh et al.
2008/0069617 A1 3/2008 Matsumoto et al.
2008/0070149 A1 3/2008 Kato et al.
2008/0076054 A1 3/2008 Nozaki et al.
2008/0081273 A1 4/2008 Murakami et al.
2008/0096119 A1 4/2008 Yamamoto et al.
2008/0101823 A1 5/2008 Katoh et al.
2008/0124635 A1 5/2008 Nakamura et al.
2008/0131797 A1 6/2008 Ishikawa et al.
2008/0153018 A1 6/2008 Mikuriya et al.
2008/0159777 A1 7/2008 Fuwa et al.
2008/0175630 A1 7/2008 Yasunaga et al.
2008/0176159 A1 7/2008 Matsumoto et al.
2008/0199234 A1 8/2008 Hagi et al.
2008/0220357 A1 9/2008 Nozaki et al.
2008/0226356 A1 9/2008 Yasunaga et al.
2008/0227001 A1 9/2008 Kadota et al.
2008/0227009 A1 9/2008 Fuwa et al.
2008/0227013 A1 9/2008 Kadota et al.
2008/0227016 A1 9/2008 Nozaki et al.
2008/0232857 A1 9/2008 Matsumoto et al.
2008/0233496 A1* 9/2008 Kotsugai et al. ..... 430/48
2008/0233497 A1 9/2008 Yamamoto et al.
2008/0233506 A1 9/2008 Hagi et al.
2008/0233510 A1 9/2008 Nozaki et al.
2008/0233511 A1 9/2008 Ishikawa et al.
2008/0279591 A1 11/2008 Yasunaga et al.
(Continued)

FOREIGN PATENT DOCUMENTS

JP 2005-156824 6/2005
JP 2005-157343 6/2005
(Continued)

*Primary Examiner* — Janis L Dote
(74) *Attorney, Agent, or Firm* — Oblon, McClelland, Maier & Neustadt, L.L.P.

(57) ABSTRACT

A toner is prepared by wet granulation methods, including a monoester wax having carbon atoms of from 36 to 46 on average as a release agent. The toner has a DSC endothermic energy amount (ΔH1) originating from the wax of from 10 to 12 mJ/mg and a DSC endothermic energy amount (ΔH2) originating from the wax of from 0.6 to 0.9 times as much as ΔH1 after a part of the wax is separated by hexane extraction from the toner. The hexane extraction includes mixing 1 g of the toner in 7 ml of n-hexane to prepare a mixture; stirring the mixture at 120 rpm for 1 min by a pot mill to prepare a dispersion; and subjecting the dispersion to suction filtration.

13 Claims, 3 Drawing Sheets

(56) References Cited

U.S. PATENT DOCUMENTS

| | | | | |
|---|---|---|---|---|
| 2008/0304875 | A1 | 12/2008 | Katoh et al. | |
| 2009/0017391 | A1 | 1/2009 | Yamamoto et al. | |
| 2009/0035685 | A1* | 2/2009 | Tamura et al. | 430/109.4 |
| 2009/0041511 | A1 | 2/2009 | Fuwa et al. | |
| 2009/0052952 | A1 | 2/2009 | Katoh et al. | |
| 2009/0117481 | A1 | 5/2009 | Yasunaga et al. | |
| 2009/0162772 | A1 | 6/2009 | Fuwa et al. | |
| 2009/0169270 | A1 | 7/2009 | Fuwa et al. | |
| 2009/0186289 | A1 | 7/2009 | Nakamura et al. | |
| 2009/0186291 | A1 | 7/2009 | Mikuriya et al. | |
| 2009/0220879 | A1 | 9/2009 | Matsumoto et al. | |
| 2009/0232542 | A1 | 9/2009 | Yamamoto et al. | |
| 2009/0233199 | A1 | 9/2009 | Nozaki et al. | |
| 2009/0257792 | A1 | 10/2009 | Nakamura et al. | |
| 2009/0297975 | A1 | 12/2009 | Ishikawa et al. | |
| 2009/0297976 | A1 | 12/2009 | Yamamoto et al. | |
| 2010/0009282 | A1 | 1/2010 | Katoh et al. | |
| 2010/0055603 | A1 | 3/2010 | Nozaki et al. | |
| 2010/0150609 | A1 | 6/2010 | Nozaki et al. | |
| 2010/0167196 | A1 | 7/2010 | Hagi et al. | |
| 2010/0239974 | A1 | 9/2010 | Nozaki et al. | |
| 2011/0045401 | A1 | 2/2011 | Murakami et al. | |
| 2011/0053063 | A1 | 3/2011 | Kadota et al. | |
| 2011/0053071 | A1 | 3/2011 | Miki et al. | |
| 2011/0053077 | A1 | 3/2011 | Mikuriya et al. | |
| 2011/0065036 | A1* | 3/2011 | Inoue | G03G 9/08755 430/108.2 |
| 2011/0164901 | A1 | 7/2011 | Yamamoto et al. | |
| 2011/0217644 | A1 | 9/2011 | Yamamoto et al. | |
| 2011/0244383 | A1 | 10/2011 | Yamamoto et al. | |
| 2011/0250533 | A1 | 10/2011 | Kadota et al. | |
| 2011/0287356 | A1 | 11/2011 | Fukao et al. | |
| 2012/0189951 | A1* | 7/2012 | Sugimoto et al. | 430/108.2 |
| 2012/0219321 | A1 | 8/2012 | Fukao et al. | |
| 2012/0237253 | A1 | 9/2012 | Fukao et al. | |
| 2012/0237267 | A1 | 9/2012 | Fukao et al. | |
| 2012/0251938 | A1 | 10/2012 | Yamamoto et al. | |
| 2012/0264048 | A1 | 10/2012 | Ishikawa et al. | |
| 2012/0328976 | A1 | 12/2012 | Seki et al. | |
| 2013/0029260 | A1 | 1/2013 | Nozaki et al. | |
| 2013/0196260 | A1* | 8/2013 | Yoshida | G03G 9/08755 430/105 |

FOREIGN PATENT DOCUMENTS

| | | |
|---|---|---|
| JP | 2005-195933 | 7/2005 |
| JP | 2006-119256 | 5/2006 |
| JP | 2006-235302 | 9/2006 |
| JP | 2006-301093 | 11/2006 |
| JP | 2007-065172 | 3/2007 |
| JP | 2007-192906 | 8/2007 |
| JP | 2011-046865 | 3/2011 |
| JP | 2011-095286 | 5/2011 |
| JP | 2011-123483 | 6/2011 |
| JP | 2011-133518 | 7/2011 |

* cited by examiner

TONER

CROSS-REFERENCE TO RELATED APPLICATIONS

This patent application is originating from and claims priority pursuant to 35 U.S.C. §119 to Japanese Patent Application No. 2012-260831, filed on Nov. 29, 2012, in the Japan Patent Office, the entire disclosure of which is hereby incorporated by reference herein.

BACKGROUND

Technical Field

The present invention relates to a toner used in an image forming apparatus using an electrostatic duplication process such as copiers, facsimiles and printers.

Description of the Related Art

As a method of preparing a toner, besides a conventional kneading and pulverizing method, a chemical toner method such as a suspension method and an emulsification method using an organic solvent and an aqueous medium, a suspension polymerization method controlling and polymerizing a polymerizable monomer drop to direction form a toner, and an agglutination method agglutinating emulsified particles to form a toner is known.

As one of the chemical toners, a core/shell toner formed of a core including a resin advantageously used for heat fixation and covered with a resin advantageously used for charging and heat resistance is known.

Among them, in consideration of bleed-out of a release agent when a toner is fixed, Japanese published unexamined application No. JP-2011-095286-A discloses a toner having a partially-coated shell in the shape of a projection, and Japanese published unexamined application No. JP-2011-046865-A discloses a core shell toner having high adherence of the core to a resin.

A toner typically includes a wax to prevent offset when fixed.

When a toner includes a large amount of a wax to further improve offset prevention in high-speed printing, the wax is poorly dispersed, resulting in not only insufficient fixability, but also various problems such as poor developability, durability and preservation stability.

Japanese published unexamined application No. JP-2006-301093-A discloses an image forming method using a toner having a wax concentration of from 0.02 to 0.70 mg/cm$^3$ in a resultant extraction liquid after dispersed in n-hexane at 23° C. and a concentration of 15 mg/cm$^3$ and extracted for 1 min, and a specific fixer.

When the wax concentration is not less than 0.02 mg/cm$^3$, at least a part of the wax is uniformly dispersed in a binder resin of a toner on the molecular level, and wax particles and wax domains largely decrease in the toner.

In Japanese published unexamined application No. JP-2006-301093-A, aliphatic hydrocarbon wax is preferably used, and paraffin wax is more preferably used. However, non-polar wax such as paraffin wax is comparatively difficult to uniformly disperse in polyester resin. Further, when the wax is finely dispersed on the molecular level, the resultant toner noticeably deteriorates in releasability. Rather, when large wax domains are dispersed, only the wax exudes and the resultant toner improves in releasability.

Conventionally, when the wax in a toner is increased, an amount thereof exposed on the surface thereof is increased at the same time, resulting in problems such as contaminated development. When the exposed amount is limited with a wax dispersion aid or by controlling a polarity of the binder resin, the wax working when the toner is fixed is decreased, resulting in insufficient offset prevention. Further, when a non-polar wax having a low melt viscosity is used to prevent offset, the non-polar wax has too low compatibility with a binder resin having high polarity to disperse, resulting in difficulty in controlling the exposed amount of the wax.

Because of these reasons, a need exists for a toner limiting a wax exposed on the surface thereof, preventing offset even when including a large amount of a wax, and having optimal fixability.

SUMMARY

Accordingly, one object of the present invention is to provide a toner limiting a wax exposed on the surface thereof, preventing offset even when including a large amount of a wax, and having optimal fixability.

Another object of the present invention is to provide a process cartridge using the toner.

A further object of the present invention is to provide a method of preparing the toner.

These objects and other objects of the present invention, either individually or collectively, have been satisfied by the discovery of a toner prepared by wet granulation methods, including a monoester wax having carbon atoms of from 36 to 46 on average as a release agent. The toner has a DSC endothermic energy amount (ΔH1) originating from the wax of from 10 to 12 mJ/mg and a DSC endothermic energy amount (ΔH2) originating from the wax of from 0.6 to 0.9 times as much as ΔH1 after a part of the wax is separated by hexane extraction from the toner. The hexane extraction includes mixing 1 g of the toner in 7 ml of n-hexane to prepare a mixture; stirring the mixture at 120 rpm for 1 min by a pot mill to prepare a dispersion; and subjecting the dispersion to suction filtration.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
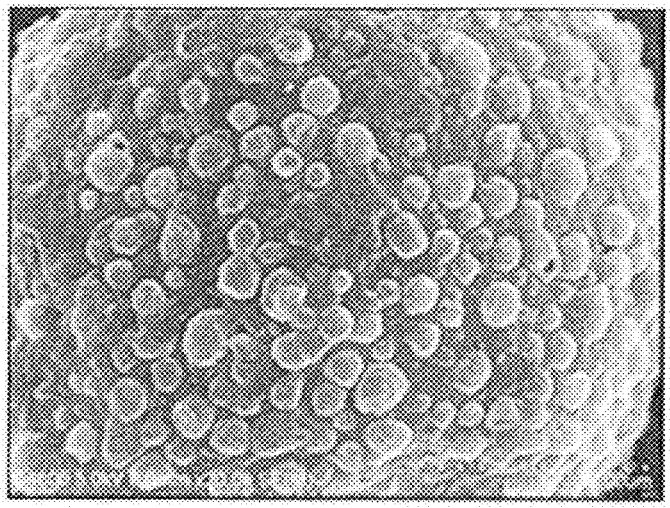
FIG. 1 is an SEM picture of toner base 1 prepared in Examples.

The present invention provides a toner limiting a wax exposed on the surface thereof, preventing offset even when including a large amount of a wax, and having optimal fixability.

The toner of the present invention is prepared by wet granulation methods, including a monoester wax having carbon atoms of from 36 to 46 on average as a release agent. The toner has a DSC endothermic energy amount (ΔH1) originating from the wax of from 10 to 12 mJ/mg and a DSC endothermic energy amount (ΔH2) originating from the wax of from 0.6 to 0.9 times as much as ΔH1 after a part of the wax is separated by hexane extraction from the toner.

In order to improve fixability of a toner and prevent a release agent from contaminating members such as an image developer, it is essential that the toner includes a monoester wax having carbon atoms of from 36 to 46 on average, ΔH1 is from 10 to 12 mJ/mg and ΔH2 is from 0.6 to 0.9 times as much as ΔH1. When ΔH1 is less than 10, the release agent is short and offset is likely to occur when the toner is fixed. When greater than 12, a fixed image is likely to cloud, resulting in low image quality. When ΔH2/ΔH1 is greater than 0.9, the release agent around the surface of a toner is too few and offset when a toner is fixed is likely to occur. When less than 0.6, the release agent around the surface of a toner is too many, resulting in problems due to the release agent.

The toner is preferably prepared by wet granulation methods. In pulverization methods, when a kneaded mixture of a resin and a release agent is pulverized, release agent interface is likely to crack, resulting in exposition of the release agent on the surface of a toner. It is very difficult to prevent this, and more difficult when a large amount of release agent is included in a toner as the present invention. In the wet granulation method of the present invention, when a release agent dispersion in which a release agent is finely dispersed is prepared, a resin having a polarity close to that of the release agent is mixed in the dispersion to control dispersion and domain diameter of the release agent in a toner and prevent the release agent from being eccentrically located at the surface of the toner. The dissolution suspension method of the present invention controls a ratio of an oil phase to an aqueous phase, a ratio of an organic solvent in the oil phase, viscosity of the aqueous phase, etc. to control location of the release agent in an emulsified droplet.

Further, in the present invention, resin particles adhere to the surface of a toner to cover a part thereof such that an amount of the release agent present at the surface of the toner separable by the hexane extraction can be controlled.

In the present invention, the hexane extraction includes adding 7 ml of n-hexane to 1 g of a toner to prepare a mixture, stirring the mixture by a pot mill at 120 rpm for 1 min to prepare a dispersion, and immediately subjecting the dispersion to suction filtration. This removes a part of the wax (exposed on the surface).

A screw tube bottle having a capacity of 30 ml is used as a container containing the toner an n-hexane. The filtration can use a membrane filter made of PTFE having an opening of 1 μm.

Measurement of glass transition point of a polyester resin and vinyl copolymer resins includes heating from room temperature to 170° C. at 10° C./min to prepare a $1^{st}$ scan data using a differential scanning calorimeter DSC-6220R form Seiko Instruments, Inc.; keeping at 170° C. for 2 min; cooling to 0° C.; keeping for 2 min; and heating to 110° C. at 5° C./min to prepare a $2^{nd}$ scan data. The glass transition point is an intersection point with a tangent of a curve.

However, the $1^{st}$ scan glass transition point of a toner is occasionally inaccurate because of being overlapped with a melting heat curve of a wax included in the toner. Therefore, in the present invention, the $1^{st}$ scan glass transition point of a toner is measured by a flow tester mentioned later (TgA).

The endothermic energy amount and melting point of a release agent or a crystalline resin can be similarly measured. In the present invention, the endothermic energy amount and melting point are measured from the $2^{nd}$ scan data. The endothermic energy amount is measured from a peak area of an endothermic peak. The endothermic energy amount is calibrated measuring a standard sample of indium. In the present invention, it is represented by ΔH at a unit of mJ/mg and almost proportionate to an amount of a release agent included in a toner. Therefore, an endothermic energy amount (ΔH2) originating from monoester wax filtrated by the hexane extraction is compared with an endothermic energy amount (ΔH1) originating from monoester wax before extracted to determine a ratio (ΔH2/ΔH1) of a release agent amount remaining in a toner a part of the release agent is separated from by the hexane extraction to a release agent amount originally included in the toner. A difference (ΔH1−ΔH2) between the toner before extracted and the toner filtrated by the hexane extraction is almost proportionate to the release agent amount separated from the toner by the hexane extraction. This is an index of the release agent amount present at the surface of a toner separable by the hexane extraction. Typically, a release agent used in a toner melts at a temperature lower than a fixable temperature of the toner, and the melting heat is an endothermic peak. Some release agents include a transfer heat due to solid phase transfer besides the melting heat. In the present invention, the endothermic energy amount is a total of them.

When a mixture of the monoester waxes is used, endothermic peaks separately appear in some cases. In those cases, a total of them is ΔH1 or ΔH2.

The release agent for use in the present invention includes at least a monoester wax having 36 to 46 carbon atoms on average. When less than 36, the melting point is too low to maintain heat resistant preservability. When greater than 46, the melting point is too high to maintain releasability of the toner when fixed.

Specific examples of the monoester wax having 36 to 46 carbon atoms include synthesized products between higher fatty acids such as behenyl behenate and stearyl stearate and higher alcohols and their mixtures. Specific examples of the higher fatty acids include a palmitic acid, a stearic acid, an arachidic acid, a behenic acid, a montanic acid, cerinic acid, etc. Specific examples of the higher alcohols include cetyl alcohol, stearyl alcohol, octydodecanol, behenyl alcohol, etc. When mixed waxes are used, they essentially have 36 to 46 carbon atoms on average, and preferably has solubility in n-hexane and a melting point of from 60 to 80° C. The solubility in solubility in n-hexane includes a wax present in the shape of a particle or a small domain at the surface of a toner transferring to n-hexane when the toner contacts n-hexane. Besides the above-mentioned waxes as a main component, other known was may be mixed in a small amount because of tuning thermal properties of the toner.

The number of carbon atoms of the wax can be measured by GPC.

A toner preferably includes the wax in an amount of from 4 to 10% by weight, more preferably from 6 to 8% by weight, and furthermore preferably from 6.5 to 7.5% by weight. However, these are not necessarily essential because of being means of controlling endothermic energy amount originating from a wax, measured by DSC.

The toner of the present invention is formed of a base formed of a main part including at least a first resin, the release agent and a colorant, and a convex part formed of resin particles on the main part; and inorganic particles. The toner has a sea-island structure in which the main part is a sea and the convex part is an island, and the resin particles are preferably different from the first resin in the main part.

It is preferable that the first resin forming the main part is formed of a polyester resin and the resin particles are formed of vinyl resins.

In order to further improve fixability, the location of a wax is important and a specific amount thereof needs to be present at the surface of a toner. However, when a wax is located at the surface of a toner, it is necessary to prevent the wax from contaminating members and deteriorating heat resistant preservability. In order to achieve thus, resin particles not including a wax are located at the surface of a toner to form a convex part. A gap between the convex parts does not prevent the wax from exuding, which enables a toner to have fixability and heat resistant preservability.

The first resin forming the main part of the toner of the present invention is preferably a polyester resin. The main part preferably includes a modified polyester resin having a urethane and/or a urea group. Further, the main part preferably includes a crystalline polyester resin, and at least a crystalline resin and an amorphous resin.

The crystalline resin and the amorphous resin are incompatibly present until fixed. The amorphous resin has a glass transition point (or a transition point to rubber), and the crystalline resin has a melting point. Even in electrophotographic process, the amorphous resin does not change in glass transition point from an image developer through development and transfer until fixed on an image forming medium such as papers. Meanwhile, the crystalline resin and the amorphous resin are quickly compatibilized each other with heat and pressure and transform to a rubber when fixed. The crystalline resin and the amorphous resin are preferably compatibilized each other quickly and completely when fixed. As long as the crystalline resin is included, it is preferable that it is compatibilized maximally and does not leave crystal. Behaviors thereof without being pressurized are examined by DSC to prove that it is preferable that an endothermic peak of the crystalline resin almost disappear when heated and cooled once.

The content of the crystalline resin is preferably from 0 to 10% by weight, more preferably from 2 to 6% by weight, and further more preferably from 2.5 to 4% by weight based on total weight of the crystalline resin and the amorphous resin. The crystalline resin improves low-temperature fixability because of its plasticization effect. However, when the content thereof is too much, they are partially compatibilized and heat resistant preservability possibly deteriorates, it is preferably 10% or less.

The toner of the present invention preferably has a sea-island structure formed of a main part including at least a resin, a release agent and a colorant (sea); and a convex part formed of resin particles (island) on the surface of the main part. The resin forming the sea includes at least a first resin and the resin particles are formed of amorphous resins. The first resin and the resin particles are not compatibilized and form the sea-island structure in a toner. The first resin forming the sea is not particularly limited, and a resin having a polyester skeleton is preferably used because the resultant toner has good fixability. The resin having a polyester skeleton includes a polyester resin and a block polymer formed of polyester and a resin having another skeleton, and the polyester resin is preferably used because the resultant colored resin has uniformity.

In the present invention, the convex part formed of resin particles is a shell and the other part is core.

The polyester resin is preferably ring-opening polymeric lactones, condensation-polymeric hydroxycarboxylic acids, polycondensed polyol and polycarboxylic acid, etc.

The polyester resin preferably has a molecular weight of from 1,000 to 30,000, more preferably from 1,500 to 10,000, and furthermore preferably from 2,000 to 8,000. When not less than 1,000, the resultant toner has good heat resistant preservability. When not greater than 30,000, the resultant toner has good low-temperature fixability. The polyester resin preferably has a glass transition temperature of from 35 to 80° C., more preferably from 40 to 70° C., and furthermore preferably from 45 to 65° C. When not less than 35° C., the resultant toner is not deformed in an environment of high temperature, and the toner particles do not adhere to with each other. When not greater than 80° C., the resultant toner has good fixability.

The toner is preferably prepared through (1) a process of dissolving or dispersing at least a resin, a colorant and a release agent forming the main part in an organic solvent to prepare a solution or a dispersion, (2) a process of dispersing the solution or the dispersion in an aqueous medium to prepare a core particle dispersion, (3) a process of adding a resin particle dispersion in which the resin particles forming the convex part are dispersed in the core particle dispersion to transfer the resin particles to the surface of the core particles, and (4) a process of removing the organic solvent from the dispersion including the core particles the convex parts are formed on.

The polyester resin for use in the present invention includes polycondensed (1) polyol and (2) polycarboxylic acid. Any polyester resins can be used and some polyester resins may be combined.

Specific examples of the polyols (1) include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenols such as bisphenol A, bisphenol F and bisphenol S; 4,4-dihydroxybiphenyls such as 3,3'-difluoro-4,4-dihydroxybiphenyl; bis(hydroxyphenyl)alkanes such as bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (tetrafluorobisphenol A), and 2,2-bis(3-hydroxyphenyl)-1,1,1,3,3,3-hexafluoropropane; bis(4-hydroxyphenyl)ethers such as a bis(3-fluoro-4-hydroxyphenyl)ether; adducts of the above-mentioned alicyclic diol with an alkylene oxide such as ethylene oxide, propylene oxide and butylene oxide; adducts of the above-mentioned bisphenol with an alkylene oxide such as ethylene oxide, propylene oxide and butylene oxide, etc.

In particular, alkylene glycol having 2 to 12 carbon atoms and adducts of bisphenol with an alkylene oxide are preferably used, and a mixture thereof is more preferably used.

Further, multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide can also be used.

These polyols can be used alone or in combination, and are not limited thereto.

Specific examples of the polycarboxylic acids (2) include alkylene dicarboxylic acids such as a succinic acid, an adipic acid and a sebacic acid; alkenylene dicarboxylic acids such as a maleic acid and a fumaric acid; and aromatic dicarboxylic acids such as a phthalic acid, an isophthalic acid, a terephthalic acid and a naphthalene dicarboxylic acid, a 3-fluoroisophthalic acid, a 2-fluoroisophthalic acid, a 2-fluoroterephthalic acid, a 2,4,5,6-tetrafluoroisophthalic acid, a 5-trifluoromethylisophthalic acid, 2,2-bis(4-carboxyphenyl) hexafluoropropane, 2,2-bis(3-carboxyphenyl)hexafluoropropane, a 2,2'-bis(trifluoromethyl)-4,4'-biphenyl dicarboxylic acid, a 3,3'-bis(trifluoromethyl)-4,4'-biphenyldicarboxylic acid, a 2,2'-bis(trifluoromethyl)-3,3'-biphenyldicarboxylic acid, a hexafluoroisopropylidenediphthalic acid anhydride, etc.

In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences include aromatic polycarboxylic acids having 9 to 20 carbon atoms such as a trimellitic acid and a pyromellitic acid. In addition, the polycarboxylic acid can be formed from a reaction between the polyol (1) and the above-mentioned acids anhydride or lower alkyl ester such as methyl ester, ethyl ester and isopropyl ester.

These polycarboxylic acids can be used alone or in combination, and are not limited thereto.

The polyol and polycarboxylic acid are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polyester resin preferably has a peak molecular weight of from 1,000 to 30,000, preferably from 1,500 to 10,000, and more preferably from 2,000 to 8,000. When less than 1,000, heat resistant preservability of the resultant toner deteriorates. When greater than 30,000, low-temperature fixability thereof deteriorates.

A binder resin included in the toner of the present invention may include a modified polyester resin having a urethane group and/or a urea group to control viscoelasticity of the toner. The toner preferably includes the modified polyester resin having a urethane group and/or a urea group in an amount not greater than 20% by weight, more preferably not greater than 15% by weight, and furthermore preferably not greater than 10% by weight. When greater than 20% by weight, the low-temperature fixability deteriorates. The modified polyester resin having a urethane group and/or a urea group may directly be mixed with a binder resin, however, in terms of productivity, it is more preferable that a comparatively a low-molecular-weight modified polyester resin (hereinafter referred to as a prepolymer) and amines reactable therewith are elongated and/or cross-linked with each other while or after the toner is granulated to form the modified polyester resin having a urethane group and/or a urea group. This facilitates including comparatively a polymeric modified polyester resin at the core of the toner to control the viscoelasticity thereof.

Specific examples of the prepolymer having an isocyanate group include a polymer formed from a reaction between polyester having an active hydrogen atom formed by polycondensation between the polyol (1) and the polycarboxylic acid (2), and polyisocyanate (3). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

Specific examples of the polyisocyanate (3) include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as $\alpha,\alpha,\alpha',\alpha'$-tetramethylxylylenediisocyanate; isocyanurate; the above-mentioned polyisocyanate blocked with phenol derivatives, oxime and caprolactam; and their combinations.

The polyisocyanate (3) is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates. The content of the constitutional component of a polyisocyanate in the polyester prepolymer (A) having a polyisocyanate group at its end portion is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the modified polyester after elongated and/or cross-linked decreases and hot offset resistance of the resultant toner deteriorates.

Specific examples of amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorone diamine); aliphatic diamines (e.g., ethylene diamine, tetramethylene diamine and hexamethylene diamine); etc.

Specific examples of the polyamines (B2) having three or more amino groups include diethylene triamine, triethylene tetramine.

Specific examples of the amino alcohols (B3) include ethanol amine and hydroxyethyl aniline.

Specific examples of the amino mercaptan (B4) include aminoethyl mercaptan and aminopropyl mercaptan.

Specific examples of the amino acids (B5) include amino propionic acid and amino caproic acid.

Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc.

The molecular weight of the modified polyester can optionally be controlled using an elongation anticatalyst, if desired. Specific examples of the elongation anticatalyst include monoamines such as diethyle amine, dibutyl amine, butyl amine and lauryl amine, and blocked amines, i.e., ketimine compounds prepared by blocking the monoamines mentioned above.

The toner of the present invention preferably includes crystalline polyester to improve low-temperature fixability thereof. The crystalline polyester is also the polycondensed polyol and polycarboxylic acid. Specific examples of the polyol include aliphatic diols such as ethylene glycol, 1,2-propylene glycol, 1,3-propylene glycol, 1,4-butane diol, 1,5-pentane diol, 1,6-hexane diol, 1,7-heptane diol, 1,8-octane diol, neopentyl glycol and 1,4-butene diol. Among these, 1,4-butane diol, 1,6-hexane diol and 1,8-octane diol are preferably used, and 1,6-hexane diol is more preferably used. Specific examples of the polycarboxylic acid include aromatic dicarboxylic acids such as a phthalic acid, an isophthalic acid and a terephthalic acid; and aliphatic carboxylic acids having 2 to 8 carbon atoms. The aliphatic carboxylic acids are preferably used to increase crystallization.

The crystalline resin (crystalline polyester) and the amorphous resin are identified by thermal properties. The crystalline resin has an obvious endothermic peak like waxes when subjected to DSC measurement. The amorphous resin has a moderate curve due to glass transition.

Vinyl resins are preferably used as the resin particles forming the convex part of the toner of the present invention. The resin particles formed of the vinyl resins are obtained by polymerizing a monomer mixture mainly including an aromatic compound having a vinyl polymerizable functional group as a monomer.

The monomer mixture preferably includes the aromatic compound having a vinyl polymerizable functional group in an amount of from 80 to 100% by weight, more preferably from 90 to 100% by weight, and furthermore preferably from 95 to 100% by weight. When less than 80% by weight, the resultant toner does not have enough chargeability.

Specific examples of the polymerizable functional group of the aromatic compound having a vinyl polymerizable functional group include vinyl groups, isopropenyl groups, allyl groups, acryloyl groups, methacryloyl groups, etc.

Specific examples of the monomer include styrene, α-methylstyrene, 4-methylstyrene, 4-ethylstyrene, 4-tert-butylstyrene, 4-methoxystyrene, 4-ethoxystyrene, 4-carboxystyrene or its metallic salts, 4-styrenesulfonate or its metallic salts, 1-vinylnaphthalene, 2-vinylnaphthalene, allylbenzene, phenoxyalkyleneglycolacrylate, phenoxyalkyleneglycolmethacrylate, phenoxypolyalkyleneglycolacrylate, phenoxypolyalkyleneglycolmethacrylate, methoxydiethyleneglycolmethacrylate, etc.

Among these, styrene is preferably used because of being easily obtainable, and having good reactivity and high chargeability.

The vinyl resins used in the present invention may include a vinyl polymerizable group and a compound having an acidic group (acidic monomer) in an amount of from 0 to 7% by weight based on total weight of the monomer mixture. The content of the acidic monomer is preferably 0 to 4% by weight, and more preferably zero. When the acidic monomer is used in an amount greater than 7% by weight, the resultant vinyl resin particles have high dispersion stability. Even when the vinyl resin particles added to a dispersion in which oil drops are dispersed in an aqueous phase, they are difficult to adhere at normal temperature or likely to release even when having adhered. They are easily released in the processes of removing a solvent, washing, drying and applying an external additive. When not greater than 4% by weight, the resultant toner has less variation in chargeability due to environment.

Specific examples of the acidic group of the compound having an acidic group include carboxylic acids, sulfonyl acids, phosphoryl acids, etc.

Specific examples of the compound having an acidic group include vinyl monomers including a carboxyl group and their salts such as (meth)acrylic acids, maleic acid anhydrides, monoalkyl maleate, fumaric acids, monoalkyl fumarate, crotonic acids, itaconic acids, monoalkyl itaconate, glycol monoether itaconate, citraconic acids, monoalkyl citraconate and cinnamic acids; vinyl monomers including a sulfonic acid group and vinyl monoester sulfate and their salts; vinyl monomers including a phosphoric acid group and their salts, etc. Among these, (meth)acrylic acids, maleic acid anhydrides, monoalkyl maleate, fumaric acids and monoalkyl fumarate are preferably used.

When these have high compatibility with the resin of the core, the polarities and the structures of the resins of the monomer mixture and the core are controlled to have lower compatibility so as to have desired toner surface.

The resin particles should not be dissolved more than necessary. When dissolved so as not to keep particulate forms, the resultant toner occasionally does not have a desired surface.

Methods of obtaining vinyl resin particles are not particularly limited, and include the following (a) to (f).

(a) A monomer mixture is polymerized by polymerization methods such as suspension polymerization methods, emulsification polymerization methods, seed polymerization methods and dispersion polymerization methods to prepare resin particles.

(b) A monomer mixture is previously polymerized to prepare a resin, and the resin is pulverized by mechanically rotational or jet pulverizers and classified to prepare resin particles.

(c) A monomer mixture is previously polymerized to prepare a resin, the resin is dissolved in a solvent to prepare a resin solution, and the resin solution is sprayed to prepare resin particles.

(d) A monomer mixture is previously polymerized to prepare a resin, the resin is dissolved in a solvent to prepare a resin solution, and a solvent is added to the resin solution or the resin solution previously heated and dissolved in a solvent is cooled to precipitate resin particles, and a solvent is removed to prepare resin particles.

(e) A monomer mixture is previously polymerized to prepare a resin, the resin is dissolved in a solvent to prepare a resin solution, and the resin solution is dispersed in an aqueous medium under the presence of a suitable dispersant to prepare a dispersion, and the solvent is removed therefrom by heating or depressurizing.

(f) A monomer mixture is previously polymerized to prepare a resin, the resin is dissolved in a solvent to prepare a resin solution, a suitable emulsifier is dissolved in the resin solution, and water is added thereto to perform phase-transfer emulsification.

Among these, (a) is preferably used because resin particles are easily prepared and obtained as a dispersion smoothly applicable to the following process.

In (a), a dispersion stabilizer is added in an aqueous medium or a monomer capable of imparting dispersion stability to the polymerized resin particles (a reactive emulsifier) is added in a monomer to be polymerized, or these two methods are combined to impart dispersion stability to the resultant vinyl resin particles. Without dispersion stabilizers and reactive emulsifiers, vinyl resins cannot be obtained as particles because of being incapable of keeping them dispersed, the resultant resin particles do not have enough preservation stability and agglutinate while stored because of having low dispersion stability, or core particles are likely to agglutinate or combine with each other in a resin particle application process mentioned later and the resultant toner has poor uniformity of particle diameter, shape and surface.

Specific examples of the dispersion stabilizers include surfactants and inorganic dispersants. Specific examples of the surfactants include anionic surfactants such as alkylbenzene sulfonate, α-olefin sulfonate and ester phosphate; amine salts such as alkyl amine salts, amino alcohol fatty acid derivatives, polyamine fatty acid derivatives and imidazoline; quaternary ammonium salt cationic surfactants such as alkyltrimethylammonium salts, dialkyldimethylammonium salts, alkyl dimethyl benzyl ammonium salts, pyridinium salts, alkyl isoquinolinium salts and benzetonium chloride; nonionic surfactants such as fatty acid amide derivatives and polyol derivatives; and amphoteric surfactants such as alanine, dodecyl(aminoethyl)glycin, di(octylaminoethyl)glycin and N-alkyl-N,N-dimethylammonium betaine. Specific examples of the inorganic dispersants include tricalcium phosphate, calcium carbonate, titanium oxide, colloidal silica, hydroxy apatite, etc.

Typical chain-transfer agents can be used when the resin particles of the present invention are prepared to control molecular weight thereof. The chain-transfer agents are not particularly limited, and alkyl mercaptan chain-transfer agents having three or more carbon atoms are preferably used. Specific examples of the hydrophobic alkyl mercaptan chain-transfer agents having three or more carbon atoms include, but are not limited to, butane thiol, octane thiol, decane thiol, dodecane thiol, hexadecane thiol, octadecane thiol, cyclohexyl mercaptan, thiophenol, octyl thioglycolate, octyl 2-mercaptopropionate, octyl 3-mercaptopropionate, 2-ethylhexylester mercaptopropionate, 2-mercaptoethylester octanoate, 1,8-dimercapto-3,6-dioxaoctan, decanetrithiol, dodecylmercaptan, etc. The hydrophobic chain-transfer agents may be used alone or in combination.

The content of the chain-transfer agents is not particularly limited if the resultant copolymer has a desired molecular weight, and preferably from 0.01 to 30 parts by weight, and more preferably from 0.1 to 25 parts by weight based on total molecular weight of the monomer components. When less than 0.01 parts by weight, the resultant copolymer has too much molecular weight, and the resultant toner possibly deteriorates in fixability and gelates during the polymerization reaction. When greater than 30 parts by weight, the chain-transfer agent remains unreacted and resultant copolymer has too little molecular weight, resulting in member contamination.

The vinyl resin preferably has a weight-average molecular weight of from 3,000 to 300,000, more preferably from 4,000 to 100,000, and furthermore preferably from 5,000 to 50,000. When less than 3,000, the vinyl resin has low mechanical strength and the resultant toner easily varies its surface, which causes problems such as noticeable deterioration of chargeability and contamination of members. When greater than 300,000, molecular terminals decrease and molecular chains with the core decrease, resulting in deterioration of adherence to the core.

The vinyl resin preferably has a glass transition temperature (Tg) not less than 40° C., more preferably not less than 50° C., and furthermore preferably not less than 60° C. When less than 40° C., the resultant toner deteriorates in preservation stability, e.g., blocking problems occur when stored at high temperature.

Specific examples of colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner particles preferably include the colorant in an amount of from 1 to 15% by weight, and more preferably from 3 to 10% by weight.

As an external additive to subsidize the fluidity, developability and chargeability of the toner of the present invention, a particulate inorganic material is preferably used. The particulate inorganic material preferably has an average primary particle diameter of from 5 nm to 2 μm, and more preferably from 5 to 500 nm. In addition, the particulate inorganic material preferably has a specific surface area of from 20 to 500 $m^2/g$ when measured by a BET method. The toner preferably includes the particulate inorganic material in an amount of from 0.01 to 5% by weight, and more preferably from 0.01 to 2.0% by weight. Specific examples of the particulate inorganic material include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Specific examples of the other external additives include polystyrene formed by a soap-free emulsion polymerization, a suspension polymerization or a dispersion polymerization; ester methacrylate or ester acrylate copolymer; silicone; benzoguanamine; polycondensed products such as nylon; polymeric particulate materials formed of thermosetting resins; etc.

A fluidity improver for use in the present invention is a surface treatment agent to increase the hydrophobicity of a toner to prevent deterioration of fluidity and chargeability thereof even in an environment of high humidity. Specific examples thereof include a silane coupling agent, a sililating agent, a silane coupling agent having an alkyl fluoride group, an organic titanate coupling agent, an aluminium coupling agent a silicone oil and a modified silicone oil. When a release agent contaminates the surface of a photoreceptor and abnormal images like rice-fish images and filming occur, an inorganic particles such as silica including a silicone oil are preferably added to a toner as an external additive to have good cleanability.

Inorganic particles treated with silicone oil have high hydrophobicity, and improve charge environmental stability and environmental resistance of the toner.

The inorganic particles such as silica including a silicone oil preferably have a primary average particle diameter of from 30 to 100 nm, and more preferably from 30 to 80 nm. When less than 30 nm, the inorganic particles are likely to be present at the side of a toner and the silicone oil is not fed enough for cleaning thereto, resulting in worse rice-fish images. When greater than 100 nm, they are likely to leave from a toner, resulting in contamination of developing members.

The inorganic particles preferably include carbon atoms originating from the silicone oil in an amount of from 5.0 to 10.0% by weight, and more preferably from 5.0 to 8.0% by weight. When less than 5.0% by weight, the silicone oil is not fed enough for cleaning, resulting in worse rice-fish images. The environmental resistance also deteriorates. When greater than 10.0% by weight, the free silicone coil contaminates developing members.

A cleanability improver for use in the present invention is added to remove a developer remaining on a photoreceptor and a first transfer medium after transferred. Specific examples of the cleanability improver include fatty acid metallic salts such as zinc stearate, calcium stearate and stearic acid; and polymer particles prepared by a soap-free emulsifying polymerization method such as polymethylmethacrylate particles and polystyrene particles. The polymer particles comparatively have a narrow particle diameter distribution and preferably have a volume-average particle diameter of from 0.01 to 1 μm.

Methods of preparing the toner of the present invention preferably include at least the following processes (1) to (4), but are not limited thereto.

(1) A process of dissolving or dispersing at least a resin, a colorant and a release agent forming the main part in an organic solvent to prepare a solution or a dispersion.

(2) A process of dispersing the solution or the dispersion in an aqueous medium to prepare a core particle dispersion.

(3) A process of adding a resin particle dispersion in which the resin particles forming the convex part are dispersed in the core particle dispersion to transfer the resin particles to the surface of the core particles.

(4) A process of removing the organic solvent from the dispersion including the core particles the convex parts are formed on.

The organic solvent is preferably a volatile solvent having a boiling point less than 100° C. because the solvent can easily be removed afterwards. Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. The binder resin having a polyester skeleton including an aromatic group, highly-polar resin, colorant and release agent may be dissolved or dispersed together, however, typically they are independently dissolved or dispersed. The organic solvents may be different from each other, however, are preferably same in consideration of the solvent disposal afterwards. The release agent preferably used in the present invention is scarcely dissolved in an organic solvent suitable for dissolving polyester resins because of having different solubility.

A solution or a dispersion of polyester resins preferably has a resin concentration of from 40 to 80% by weight. When too high, the binder resin is difficult to dissolve or disperse in a solvent and has too high a viscosity to handle. When too low, the toner is not prepared much. When a modified polyester resin having an isocyanate group at the end of the binder resin having a polyester skeleton including an aromatic group is mixed therewith, they may be mixed in a same solution or a dispersion, or may be mixed after separately dissolved or dispersed. However, they are preferably mixed after separately dissolved or dispersed in consideration of their solubilities and viscosities.

The aqueous medium for use in the present invention includes water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone. The aqueous medium is typically used in an amount of from 50 to 2,000 parts by weight per 100 parts by weight of the resin particles, and preferably from 100 to 1,000 parts by weight.

Before a solution or a dispersion of the polyester resins and the release agent is dispersed in the aqueous medium, an inorganic dispersant or an organic particulate resin is preferably dispersed therein because particle diameter distribution of the resultant toner becomes sharp and the solution or the dispersion is stably dispersed therein. Specific examples of the inorganic dispersant include tricalcium phosphate, calcium carbonate, titanium oxide, colloidal silica, hydroxyapatite, etc. Specific examples of the organic particulate resin include any thermoplastic and thermosetting resins such as vinyl resins, a polyurethane resin, an epoxy resin, a polyester resin, a polyamide resin, a polyimide resin, silicon resins, a phenol resin, a melamine resin, a urea resin, an aniline resin, an ionomer resin, a polycarbonate resin, etc. These resins can be used alone or in combination. Among these resins, the vinyl resins, the polyurethane resin, the epoxy resin, the polyester resin and their combinations are preferably used in terms of forming an aqueous dispersion of microscopic spherical particulate resins.

Surfactants can be used when preparing the particulate resin when necessary. Specific examples thereof include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, di sodium perfluorooctanesulfonylglutamate, sodium 3-{omega-fluoroalkyl(C6-C11)oxy}-1-alkyl (C3-C4) sulfonate, sodium-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl (C6-C16)ethylphosphates, etc. Specific examples of the cationic surfactants include primary, secondary and tertiary aliphatic amines having a fluoroalkyl group, aliphatic quaternary ammonium salts such as perfluoroalkyl(C6-C10) sulfoneamidepropyltrimethylammonium salts, benzalkonium salts, benzetonium chloride, pyridinium salts, imidazolinium salts, etc.

Further, it is possible to stabilize dispersed droplets with a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid. When an acid such as calcium phosphate or a material soluble in alkaline is used as a dispersant, the calcium phosphate is dissolved with an acid such as a hydrochloric acid and washed with water to remove the calcium phosphate from a toner. Besides this method, it can also be removed by an enzymatic hydrolysis. When a dispersant is used, the dispersant may remain on the surface of a toner, but is preferably washed to remove in terms of the chargeability thereof.

The dispersion method is not particularly limited, and low speed shearing methods, high-speed shearing methods, friction methods, high-pressure jet methods, ultrasonic methods, etc. can be used. When a high-speed shearing type dispersion machine is used, the rotation speed is not particularly limited, but the rotation speed is typically from 1,000 to 30,000 rpm, and preferably from 5,000 to 20,000 rpm. The temperature in the dispersion process is typically from 0 to 150° C. (under pressure), and preferably from 20 to 80° C.

Methods of preparing an oil phase including an organic solvent, and a resin, a colorant and a release agent dissolved or dispersed therein include gradually adding and dissolving or dispersing them in the organic solvent while stirred. However, when a pigment is used as a colorant, or when a release agent or a charge controlling agent which is difficult to dissolve in an organic solvent is added, they are preferably downsized before added therein. The colorant may be included in a masterbatch, and the release agent or the charge controlling agent may be included therein as well.

A colorant, a release agent and a charge controlling agent may be dispersed in an organic solvent with a dispersion aid when necessary to prepare a wet master.

When a material soluble at less than a boiling point of an organic solvent is dispersed, it may be heated in an organic solvent while stirred with a dispersoid when necessary to be dissolved therein, and the solution is cooled while stirred o sheared to be crystallized and form a fine crystal of the dispersoid. A colorant, a release agent and a charge controlling agent dissolved or dispersed with a resin in an organic solvent may further be dispersed. Known dispersers such as beads mills and disc mills can be used when dispersing them.

Methods of dispersing an oil phase in an aqueous medium to prepare a dispersion in which core particles formed of oil phase are dispersed are not particularly limited, and include known dispersers such as low-speed shearing dispersers, high-speed shearing dispersers, friction dispersers, high-pressure jet dispersers and ultrasonic dispersers. The high-speed shearing dispersers are preferably used in order that dispersed particles have a particle diameter of from 2 to 20 μm. The high-speed shearing dispersers are not particularly limited in rpm, but preferably from 1,000 to 30,000 rpm, and more preferably from 5,000 to 20,000 rpm. The dispersion time is not particularly limited, but preferably from 0.1 to 5 min in batch methods. When longer than 5 min, undesired small-size particles remain or particles are dispersed too much and the dispersion becomes unstable, resulting in formation of aggregates and coarse particles. The dispersion temperature is preferably from 0 to 40° C., and more preferably from 10 to 30° C. When higher than 40° C., molecular movement becomes active and dispersion becomes unstable, resulting in formation of aggregates and coarse particles. When less than 0° C., shearing energy needed for dispersing increases, resulting in lowering of production efficiency.

The aqueous medium preferably includes a surfactant. The above-mentioned surfactants can be used. Disulfonic acid salts having comparatively high HLB are preferably used to efficiently disperse oil droplets including solvent. The aqueous medium preferably includes a surfactant in an amount of from 1 to 10% by weight, more preferably from 2 to 8% by weight, and furthermore preferably from 3 to 7% by weight. When greater than 10% by weight, the oil droplets become too small and a reversed micelle structure is formed, resulting in lowering of dispersion stability and coarsening of oil droplets.

In the core particle dispersion, droplets of the core particles can stably be present while stirred. Then, the vinyl resin particle dispersion is placed therein to transfer the vinyl resin particle on the core particle. The vinyl resin particle dispersion is preferably placed in the core particle dispersion in not less than 30 sec. In less than 30 sec, the dispersion changes too quickly, resulting in formation of aggregates and uneven adherence of the vinyl resin particles. Longer than 60 min is not preferable in terms of production efficiency. It is preferable that the resin particle dispersion does not include an organic solvent and the particles are dispersed is the form of solids.

The vinyl resin particle dispersion may be diluted or condensed to adjust concentration before placed in the core particle dispersion. The vinyl resin particle dispersion preferably has a concentration of from 5 to 30% by weight, and more preferably from 8 to 20% by weight. When less than 5% by weight, the organic solvent largely varies in concentration, resulting in insufficient adherence of the resin particles. When greater than 30% by weight, the resin particles are likely to be eccentrically present in the core particle dispersion, resulting in uneven adherence of the resin particles.

The resin particles preferably have a particle diameter of from 60 to 150 nm, more preferably from 80 to 140 nm, and furthermore preferably from 90 to 130 nm in the resin particle dispersion. When too small, the convex part on the surface of a toner becomes small, resulting in less shell effect. When too large, the resin particles agglutinate when transferred and gaps between the convex parts become too small.

In the present invention, it is thought that the resin particles adhere to the core particles with sufficient strength because the core particles can freely deform to form enough contact surfaces with interfaces of the resin particles when adhering to droplets of the core particles, and the resin particles are swelled or dissolved in an organic solvent and the resins thereof and in the core particles are likely to adhere to each other. Therefore, an organic solvent needs to be present enough in the dispersion. Specifically, the core particle dispersion preferably includes an organic solvent in an amount of from 10 to 70% by weight, more preferably from 30 to 60% by weight, and furthermore preferably from 40 to 55% by weight based on total weight of solid contents such as a resin, a colorant, a release agent and a charge controlling agent. When greater than 70% by weight, colored resin particles obtained by one process decreases, resulting in low production efficiency. Further, the dispersion stability lowers, resulting in unstable production. When less than 10% by weight, the resin particles do not adhere to the core particles with sufficient strength. However, when the content of an organic solvent when transferring the resin particles is lower than that when preparing the core particles, the organic solvent may be partially removed after preparing the core particles to adjust the content thereof and transfer the resin particles, and then completely removed. Known methods mentioned later can be used to completely remove the solvent.

The vinyl resin particles are preferably transferred onto the core particles at from 10 to 60° C., and more preferably from 20 to 45° C. When higher than 60° C., a needed energy increases, resulting in enlarged environmental load. In addition, the vinyl resin particles having a low acid value are present on the surface of a droplet, resulting in unstable dispersion and generation of coarse particles. When lower than 10° C., the resin particles insufficiently adhere.

Known methods can be used to remove an organic solvent from the emulsified dispersion. For example, a method of gradually heating the emulsified dispersion to completely evaporate the organic solvent therein can be used.

In order to prepare a modified polyester resin having a urethane and/or a urea group, when a modified polyester resin having an isocyanate group at the end and amines reactable therewith are added in an aqueous medium, the amines may be mixed in an oil phase before toner constituents are dispersed in the aqueous medium and may be added therein. The reaction time is dependent upon the isocyanate structure of the polyester prepolymer and the reactivity of the amines, and typically from 1 min to 40 hr, and preferably from 1 to 24 hr. The reaction temperature is typically from 0 to 150° C., and preferably from 20 to 98° C.

Known methods are used to wash and dry the toner particles dispersed in an aqueous medium.

Namely, subjecting the toner particles dispersed in an aqueous medium to a solid-liquid separation with a centrifugal separator or a filter press to prepare a toner cake; dispersing again the toner cake in ion-exchange water having a room temperature to 40° C. while controlling pH with an acid or an alkali when necessary; repeating subjecting the toner cake to a solid-liquid separation for several times to remove impurities or surfactant therefrom; and drying the toner cake with a drier such as a flash drier, a circulation drier, a decompression drier and a vibration fluidization drier to prepare a toner powder. Fine toner particles may be removed therefrom with a centrifugal separator or the toner powder can have a desired particle diameter distribution with a known classifier when necessary.

Heterogeneous particles such as release agent particles, charge controlling particles, fluidizing particles and colorant particles can be mixed with a toner powder after dried. Release of the heterogeneous particles from composite particles can be prevented by giving a mechanical stress to a mixed powder to fix and fuse them on a surface of the composite particles.

Specific methods include a method of applying an impact strength on a mixture with a blade rotating at a high-speed, a method of putting a mixture in a high-speed stream and accelerating the mixture such that particles thereof collide each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

The image forming apparatus of the present invention forms images using the toner of the present invention. The toner of the present invention can be used for both of a one-component developer and a two-component developer, and is preferably used as the one-component developer. In addition, the image forming apparatus of the present invention preferably includes an endless-type intermediate transferer. Further, the image forming apparatus of the present invention preferably includes a photoreceptor and a cleaner cleaning a toner remaining on the photoreceptor and/or the intermediate transferer. The cleaner may either have a cleaning blade or not. In addition, the image forming apparatus of the present invention preferably includes a fixer fixing an image using a heating roller or a heating belt. The fixer preferably does not need an oil application. Further, the image forming apparatus of the present invention preferably includes other means such as a discharger, a recycler and a controller when necessary.

The image forming apparatus of the present invention may configure constitutional elements such as a photoreceptor, an image developer and a cleaner as a process cartridge, and detachably include the process cartridge. The process cartridge may include a photoreceptor and one of a charger, an irradiator, an image developer, a transferer, a separator and a cleaner, and detachably installed in the image forming apparatus using a guide rail.

Figure 2:
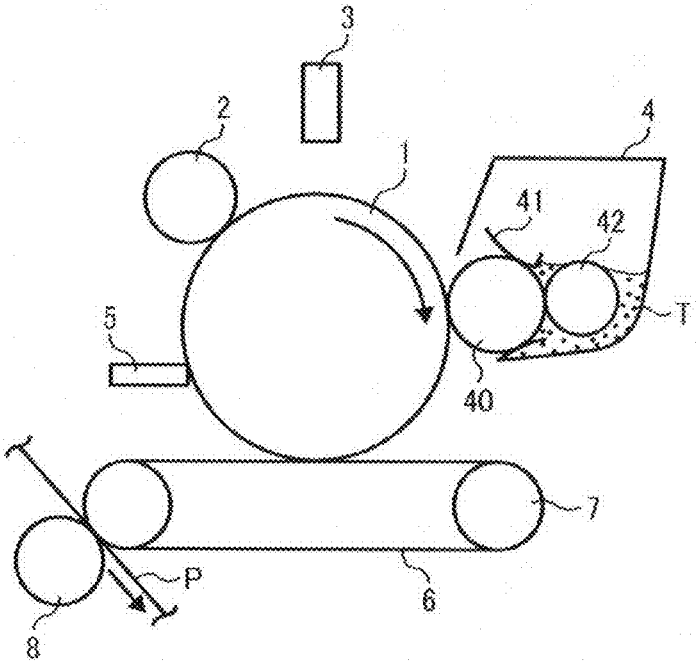
FIG. 2 is a schematic view illustrating a main part of an embodiment of image forming apparatus using the toner of the present invention.

FIG. 2 is a schematic view illustrating a main part of an embodiment of image forming apparatus using the toner of the present invention. The image forming apparatus includes a latent image bearer (1) rotating clockwise in an unillustrated chassis, and a charger (2), an irradiator (3), an image developer (4) including the toner (T) of the present invention, a cleaner (5), an intermediate transferer (6), a support roller (7), a transfer roller (8), a discharger (unillustrated), etc. around the latent image bearer (1).

The image forming apparatus includes a paper feed cassette (unillustrated) containing plural recording papers (P). The recording papers (P) in the paper feed cassette are fed by an unillustrated paper feed roller between the transfer roller (8) and the intermediate transferer (6) one by one after timing is adjusted by unillustrated pair of registration rollers.

In FIG. 2, the latent image bearer (1) is driven to rotate clockwise and uniformly charged by the charger (2). The irradiator (3) irradiates a laser modulated by image data to the latent image bearer (1) to form an electrostatic latent image thereon. The electrostatic latent image is developed by the image developer (4) with a toner to form a toner image on the latent image bearer (1). The toner image is transferred onto the intermediate transferer (6) with application of transfer bias thereto from the latent image bearer (1). Further, a recording paper (P) is fed between the intermediate transferer (6) and the transfer roller (8) to transfer the toner image onto the recording paper (P). Then, the recording paper (P) the toner image is transferred on is fed to an unillustrated fixer.

The fixer includes a fixing roller heated to have a predetermined fixing temperature by an inner heater and a pressure roller pressing a recording paper to the fixing roller at a predetermined pressure. A recording paper fed from the transfer roller (8) is heated and pressed to fix the toner image on the recording paper, and is discharged on an unillustrated paper discharge tray.

Meanwhile, the image forming apparatus further rotates the latent image bearer (1) after a toner image is transferred therefrom by the transfer roller (8) to scrape the surface of the latent image bearer (1) with the cleaner (5) to remove a toner remaining thereon, and discharges the latent image bearer (1) with an unillustrated discharger. The image forming apparatus uniformly charge the latent image bearer (1) discharged by the discharger with the charger (2) again to form a following image.

The material, shape, structure, size, etc. of the latent image bearer (1) are not particularly limited, and can be selected from known electrostatic latent image bearers. However, the latent image bearer preferably has the shape of a drum or a belt, and the material is preferably an inorganic material such as amorphous silicon and serene, and an organic material such as polysilane and phthalopolymethine. Among these materials, the amorphous silicon and the organic materials are preferably used in terms of long life.

An electrostatic latent image is formed by uniformly charging the surface of the latent image bearer (1) and irradiating imagewise light onto the surface thereof with an electrostatic latent image former. The electrostatic latent image former includes at least the charger (2) uniformly charging the surface of the latent image bearer (1) and the irradiator (3) irradiating imagewise light onto the surface thereof.

The surface of the latent image bearer (1) is charged with the charger (2) upon application of voltage.

The charger (2) is not particularly limited, and can be selected in accordance with the purpose, such as an electroconductive or semiconductive rollers, bushes, films, known contact chargers with a rubber blade, and non-contact chargers using a corona discharge such as corotron and scorotron.

The charger (2) may have the shape of a magnetic brush or a fur brush beside a roller, which can be selected according to the specification and the configuration of the image forming apparatus. The magnetic brush is formed of various ferrite particles such as Zn—Cu ferrite as a charging member, a non-magnetic conductive sleeve and a magnet roll included thereby. The fur brush is formed of a metallic core wound by a conductive fur with carbon, copper sulfate, metals or metal oxides.

The charger (2) is not limited to the contact charger, but is preferably used because of generating less ozone.

The surface of a photoreceptor is irradiated with the imagewise light by the irradiator (3). The irradiator (3) is not particularly limited, and can be selected in accordance with the purpose, provided that the irradiator (3) can irradiate the surface of the latent image bearer (1) charged by the charger (2) with the imagewise light, and include various irradiators such as reprographic optical irradiators, rod lens array irradiators, laser optical irradiators and a liquid crystal shutter optical irradiators.

An electrostatic latent image is developed by the image developer (4) with the toner of the present invention. The image developer (4) is not particularly limited provided it can develop with the toner of the present invention, and can be selected from known image developers, e.g., an image developer containing the toner of the present invention and including a developing device capable of applying the toner to an electrostatic latent image in contact or not in contact therewith is preferably used.

The image developer (4) preferably include a developing roller (40) bearing a toner on its circumferential surface, rotating in contact with the latent image bearer (1), and providing a toner to an electrostatic latent image formed on the latent image bearer (1) to form a toner image; and a thin layer forming member (41) forming a thin layer of the toner on the developing roller (40).

A metallic roller or an elastic roller is preferably used as the developing roller (40). The metallic roller is not particularly limited, and can be selected according to the purpose, e.g., an aluminum roller can be used. A metallic roller is blasted to prepare the developing roller (40) having a desired surface friction coefficient. Specifically, an aluminum roller is blasted with glass beads to coarsen the surface of the roller such that a toner adheres thereto in a suitable amount.

The elastic roller is coated with an elastic rubber layer, and a surface coated layer including a material likely to be charged to have a polarity reverse to that of a toner is formed on the surface. The elastic rubber layer has a hardness not greater than 60° when measured by the method specified in JIS-A to prevent a toner from deteriorating at a contact point with thin layer forming member (41) due to concentration of pressure. The elastic rubber layer has a surface roughness (Ra) of from 0.3 to 2.0 μm to hold a toner on the surface in a required amount. The developing roller (40) is applied with a developing bias to form an electric field between the developing roller (40) and the latent image bearer (1), and the elastic rubber layer has a resistivity of from $10^3$ to $10^{10}\Omega$. The developing roller (40) rotates clockwise, and transfers a toner held on its surface to positions facing the thin layer forming member (41) and the latent image bearer (1).

The thin layer forming member (41) is located below a position where a feed roller (42) and the developing roller (40) contact each other. The thin layer forming member (41) is formed of a metallic leaf spring such as stainless (SUS) and phosphor bronze and contact a free end thereof to the surface of the developing roller (40) at a pressure of from 10 to 40 N/m. A toner having passed the pressure forms a thin layer and is frictionally charged. Further, the thin layer forming member (41) is applied with a regulation bias offset in the same direction of charge polarity of the toner against the developing bias to assist the frictional charge.

The rubber elastic material forming the surface of the developing roller (40) is not particularly limited, and can be selected according to the purpose, e.g., styrene-butadiene copolymer rubbers, acrylonitrile-butadiene copolymer rubbers, acrylic rubbers, epichlorohydrin rubbers, urethane rubbers, silicone rubbers or their combinations are preferably used. Among these, the epichlorohydrin rubbers and the acrylonitrile-butadiene copolymer rubbers are more preferably used.

The developing roller (40) is formed by. e.g., coating the outer circumference of an electroconductive shaft with a rubber elastic material. The electroconductive shaft is formed by a metal such as stainless (SUS).

A transfer roller transfers a toner image when the latent image bearer (1) is charged. Transfer rollers preferably include a first transferer transferring a toner image onto the intermediate transferer (6) and a second transferer (the transfer roller (8)) transferring the toner image on the intermediate transferer (6) onto a recording paper (P). Then, it is preferable that the toners include two or more color toners, preferably full colors, the first transferer transfers a toner image onto the intermediate transferer (6) to form a complex transfer image and the second transferer transfers the complex image onto the recording paper (P). The intermediate transferer (6) is not particularly limited, and can be selected according to the purpose from known transferers, e.g., a transfer belt is preferably used.

The transferers, i.e., the first transferer and the second transferer preferably include at least a transfer means separating and charging a toner image formed on the latent image bearer (1) to a recording paper (P). The transfer means may be one or two or more. The transfer means include a corona charger using corona discharge, a transfer belt, a transfer roller, a pressure transfer roller, an adhesive transfer means, etc.

The recording paper (P) is typically a plain paper, but is not particularly limited, provided an unfixed image is transferable thereto and can be selected according to the purpose. PET for OHP can also be sued.

The fixer fixes a toner image transferred onto a recording paper (P), and may fix each toner image transferred thereon or layered toner images of each color at one time.

The fixer is not particularly limited and can be selected according to the purpose, and known heating and pressing means is preferably used. The heating and pressing means includes a combination of a heat roller and a pressure roller, a combination of a heat roller, a pressure roller and an endless belt. The heating and pressing means preferably heats at 80 to 200° C.

Figure 3:
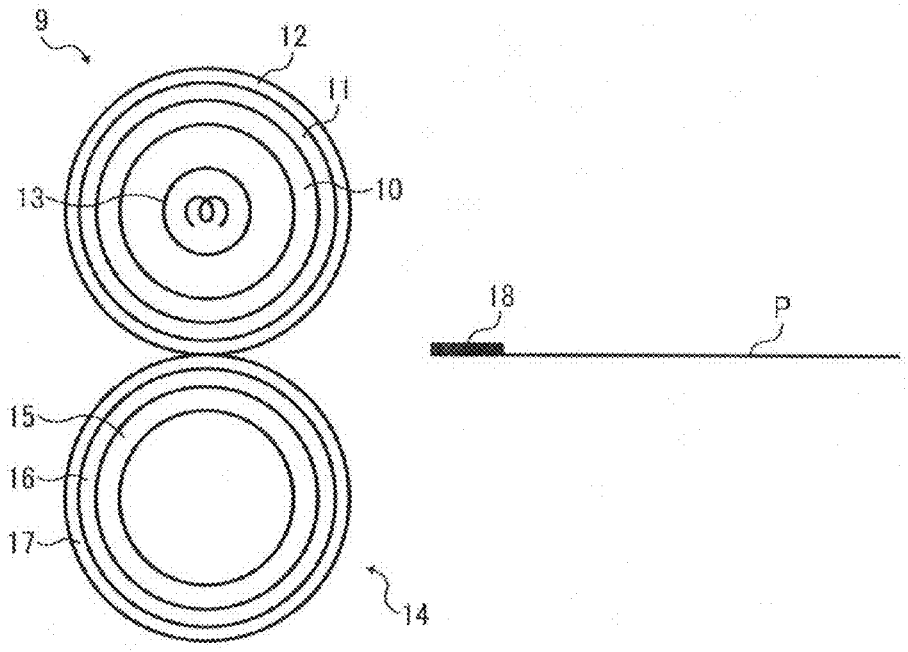
FIG. 3 is a schematic view illustrating an embodiment of fixer in image forming apparatus using the toner of the present invention.

A soft roller type fixer including a fluorine surface layer as FIG. 3 shows may be used. A heat roller (9) includes an aluminum core metal (10), an elastic material layer (11) formed of a silicone rubber overlying the aluminum core metal (10), and PFA (tetrafluoroethylene-perfluoroalkylvinylether copolymer) surface layer (12) overlying the elastic material layer (11). The aluminum core metal includes a heater (13). A pressure roller (14) includes an aluminum core metal (15), an elastic material layer (16) formed of a silicone rubber overlying the aluminum core metal (10), and PFA surface layer (17) overlying the elastic material layer (16). A recording paper (P) an unfixed image (18) is printed on is fed as illustrated.

In the present invention, known optical fixers can be used with or instead of the fixer.

A discharge bias is applied to the latent image bearer preferably by, e.g., a discharger to discharge the latent image bearer. The discharger is not particularly limited if it can apply a discharge bias to the latent image bearer, and can be selected from known dischargers such as discharge lamps.

A toner remaining on a photoreceptor is removed preferably by, e.g., a cleaner. The cleaner is not particularly limited if it can removed a toner remaining on a photoreceptor, and can be selected from known cleaners such as magnetic brush cleaners, electrostatic brush cleaners, magnetic roller cleaners, blade cleaners, brush cleaners and web cleaners.

A toner removed by the cleaner is transferred to an image developer preferably by, e.g., a recycler. The recycler is not particularly limited and includes known transfer means.

Each means is preferably controlled by a controller. The controller is not particularly limited and can be selected according to the purpose, and includes sequencer, computer, etc.

The image forming apparatus, the image forming method and the process cartridge use a toner for developing electrostatic latent image, having good fixability without deterioration such as cracks due to stress in developing process provide good images.

Figure 4:
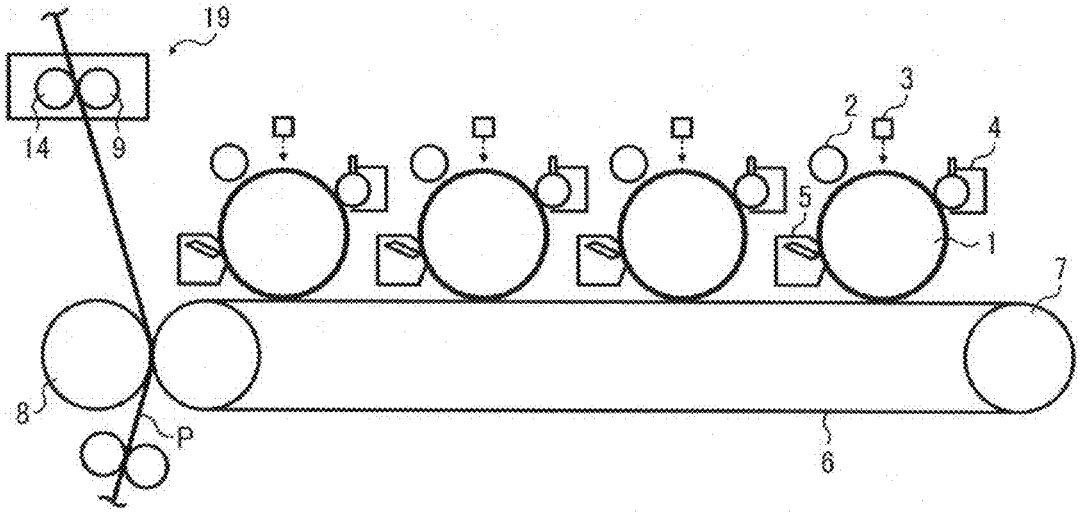
FIG. 4 is a schematic view illustrating another embodiment of image forming apparatus using the toner of the present invention.

FIG. 4 is a schematic view illustrating another embodiment of multicolor image forming apparatus using the toner of the present invention. This is a tandem-type full-color image forming apparatus.

The image forming apparatus includes a latent image bearer (1) rotating clockwise in an unillustrated chassis, and a charger (2), an irradiator (3), an image developer (4), an intermediate transferer (6), a support roller (7), a transfer roller (8), etc. around the latent image bearer (1). The image forming apparatus includes a paper feed cassette (unillustrated) containing plural recording papers (P). The recording papers (P) in the paper feed cassette are fed by an unillustrated paper feed roller between the transfer roller (8) and the intermediate transferer (6) one by one after timing is adjusted by unillustrated pair of registration rollers. A fixer (19) fixes a toner image transferred on the recording paper (p) thereon.

In FIG. 4, the latent image bearer (1) is driven to rotate clockwise and uniformly charged by the charger (2). The irradiator (3) irradiates a laser modulated by image data to the latent image bearer (1) to form an electrostatic latent image thereon. The electrostatic latent image is developed by the image developer (4) with a toner to form a toner image on the latent image bearer (1). The toner image is transferred onto an intermediate transferer from the latent image bearer (1). This is performed for each color cyan (C), magenta (M), yellow (Y) and black (K) to form a full-color toner image.

Figure 5:
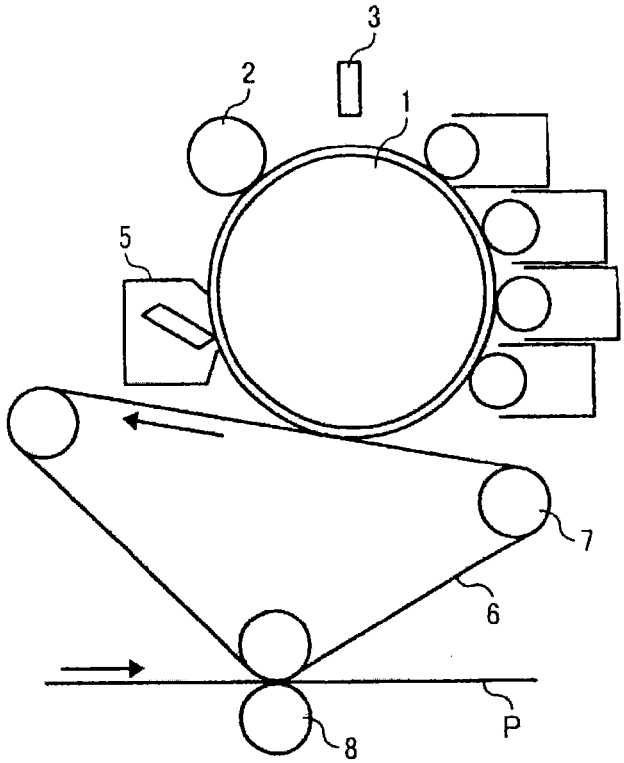
FIG. 5 is a schematic view illustrating a further embodiment of image forming apparatus using the toner of the present invention.

FIG. 5 is a schematic view illustrating a further embodiment of (revolver-type) full-color image forming apparatus using the toner of the present invention. This image forming apparatus switches the operations of the image developer to sequentially develop plural color latent images to form a full-color toner image on one latent image bearer (1). The full-color toner image on one latent image bearer (1) is transferred onto an intermediate transferer (6). Then, a transfer roller (8) transfers the full-color toner image on the intermediate transferer (6) onto a recording paper (P). The recording paper (P) the full-color toner image is transferred on is transferred to a fixer where the full-color toner image is fixed on the recording paper (P).

Meanwhile, the image forming apparatus further rotates the latent image bearer (1) after the intermediate transferer (6) transfers the toner image onto the recording paper (P) to scrape and remove a toner remaining on the latent image bearer (1) with a cleaner (5), and discharges the latent image bearer (1) with a discharger. The image forming apparatus uniformly charges the latent image bearer (1) discharged by the discharger with a charger (2) to form a following image.

The cleaner (5) may scrape off a toner remaining on the latent image bearer (1) with not only a blade but also a fur brush.

The image forming method and the image forming apparatus produce good images because of using the toner of the present invention as a developer.

The process cartridge of the present invention includes at least an electrostatic latent image bearer bearing an electrostatic latent image and an image developer developing the electrostatic latent image with a developer to form a visible image, and optional other means. The image developer includes at least a developer container containing the toner or developer of the present invention and a developer bearer bearing the toner or developer contained in the container, and further may include a layer thickness regulator regulating a layer thickness of the toner.

The process cartridge of the present invention can be detachable from various electrophotographic image forming apparatuses such as a facsimile and a printer, and is preferably detachable from the image forming apparatus of the present invention mentioned later.

Figure 6:
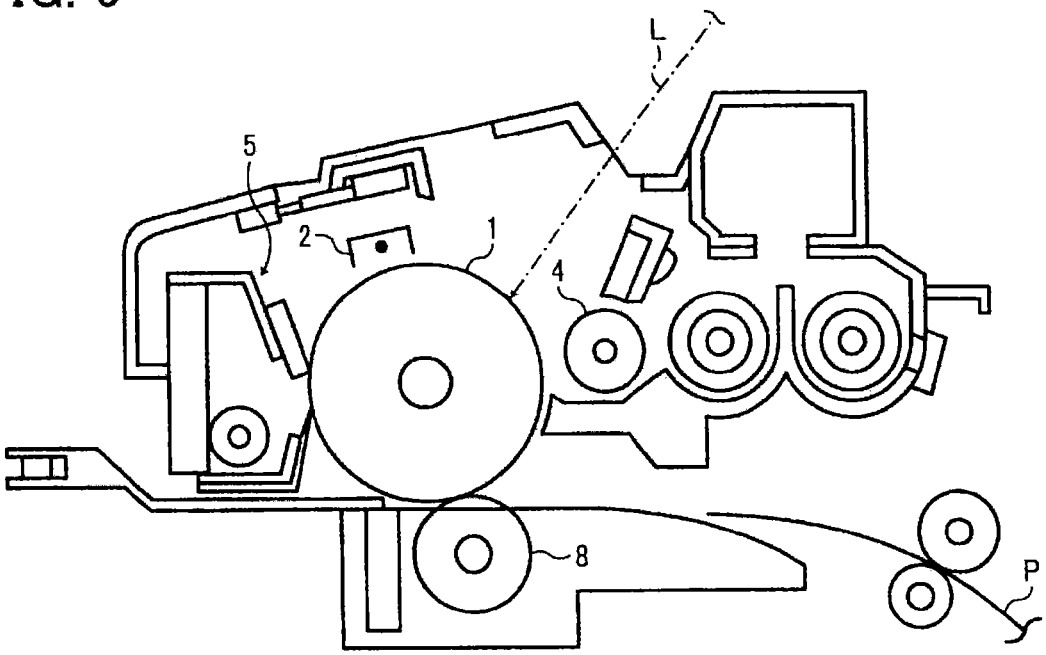
FIG. 6 is a schematic view illustrating an embodiment of process cartridge using the toner of the present invention.

The process cartridge includes, as FIG. 6 shows, a latent image bearer (1), a charger (2), an image developer (4), a transfer roller (8), a cleaner (5), and other means when necessary. In FIG. 6, (L) is light from the irradiator and (P) is a recording paper. The latent image bearer (1) may be the same as the above-mentioned image forming apparatus. The charger (2) may be a known charger.

The latent image bearer (1) is irradiated by an unillustrated irradiator with imagewise light (L) to form an electrostatic latent image thereon while rotated. The electrostatic latent image is developed with a toner by the image developer (4) to form a toner image. The toner image is transferred onto the recording paper (P) by the transfer roller (8) to be printed out. Then, the surface of the latent image bearer after transferring the toner image is cleaned by the cleaner (5), and further discharged by an unillustrated discharger to repeat this operation.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

First, methods of analyzing and evaluating the toners prepared in Examples and Comparative Examples are explained.

Each of the toners was evaluated when used as a one-component developer. The toner of the present invention can also be used as a two-component developer with a preferable external additive and a preferable carrier.

(Hexane Extraction Method-Method of Removing Wax Exposed on Surface)

Seven (7) ml of n-hexane was added to 1 g of the toner at room temperature in a screw pipe pot having a capacity of 30 ml, the mixture was stirred by a pot mill at 120 rpm for 1 min to prepare a dispersion, and the dispersion was subjected to suction filtration immediately after stirred to remove a wax exposed on the surface. A small ball mill rotary mount AV-1 from AS ONE Corp. was used as the pot mill.

A membrane filter formed of PTFE having an opening of 1 μm was used for the filtration.

<Measurement Methods>

(Particle Diameter)

The average particle diameter and particle diameter distribution of the toner can be measured by a COULTER COUNTER TA-II or COULTER MULTISIZER II from Beckman Coulter, Inc. as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

A volume-average particle diameter (Dv) and a number-average particle diameter (Dn) of the toner are determined from the distribution.

(Average Circularity)

A flow-type particle image analyzer FPIA-3000S from SYSMEX CORPORATION can measure the average circularity. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

(Volume-Average Particle Diameter of Resin Particles)

The volume-average particle diameter of the resin particles was measured by MICROTRAC ultra fine particle diameter distribution measurer UPA-EX150 using dynamic light scattering method/laser Doppler method from Nikkiso Co., Ltd. Specifically, a dispersion including dispersed resin particles is controlled to have a measurement concentration range. Then, the background measurement was previously made with only a dispersion solvent in the dispersion. Thus, some ten nm to some μm which are a range of the volume-average particle diameter of the resin particles in the present invention can be measured.

(Molecular Weight)

The molecular weights of polyester resins and vinyl copolymer resins were measured by typical GPC under the following conditions.

Measurer: HLC-8220GPC from Tosoh Corp.

Column: TSKgel SuperHZM-M×3

Temperature: 40° C.

Solvent: THF (tetrahydrofuran)

Flow Rate: 0.35 ml/min

Sample: 0.01 ml having a concentration of from 0.05 to 0.6%

From the thus measured molecular weight distribution of a toner resin, a weight-average molecular weight Mw was determined using a molecular weight calibration curve with a monodispersion polystyrene standard sample. Ten (10) monodispersion polystyrene standard samples of 5.8×100, 1.085×10000, 5.95×10000, 3.2×100000, 2.56×1000000, 2.93×1000, 2.85×10000, 1.48×100000, 8.417×100000 and 7.5×1000000.

<Evaluation Methods>

(Toner Surface)

The surface of the toner was observed by SEM to evaluate presence of fine particles.

Good: Fine particles are present as particles, forming a convex with suitable gaps Poor: Fine particles do not keep the form of particles and adhere, or particles are not observed (Fixability)

An unfixed solid stripe image of 3 mm×36 mm (toner adhered thereto in an amount of 11 g/m$^2$) was printed on a A4-size plain paper was produced by iPSiO CX2500 from Ricoh Company, Ltd. with the toner (developer) an external additive was added to. The unfixed image was fixed by the following fixer at from 110 to 170° C. at a unit of 10° C. to determine separable/non-offset temperature range. The temperature range is a fixable temperature at which a paper is well separated from a heat roller and no offset phenomena occur. The paper weighed 45 g/m$^2$ and passed in a longitudinal direction, which was disadvantageous for separability. The fixer had a peripheral speed of 200 mm/sec.

The fixer was a soft roller type having a fluorine surface layer as shown in FIG. 3. Specifically, a heat roller 9 having an outer diameter of 40 mm includes an aluminum core metal 10, an elastic layer 11 formed of silicone rubber having a thickness of 1.5 mm and overlying the core metal, a PFA (tetrafluoroethylene-perfluoroalkylvinylether copolymer) surface layer 12 overlying the elastic layer, and a heater 13 in the aluminum core metal. A pressure roller 14 having an outer diameter of 40 mm includes an aluminum core metal 15, an elastic layer 16 formed of silicone rubber having a thickness of 1.5 mm and overlying the core metal, a PFA surface layer 17 overlying the elastic layer. A paper P the unfixed image 18 was printed on passed as FIG. 3 shows.

Excellent: In a full range of 110 to 170° C., separable/non-offset and the fixed image had sufficient durability.

Good: In a full range of 110 to 170° C., separable/non-offset, but the image fixed at low temperature was peeled off or damaged Fair: Separable/non-offset temperature range was from 30° C. to less than 50° C.

Poor: Separable/non-offset temperature range was less than 30° C.

(Heat-Resistant Storageability)

After the toner was stored at 55° C. for 8 hrs, the toner was sifted by a sifter having 42 meshes for 2 min. A residual ratio of the toner on the mesh was an indication of the heat-resistant storageability.

Excellent: Less than 10%

Good: From 10 to less than 20%

Fair: From 20 to less than 30%

Poor: Not less than 30%

(Developability)

A predetermined print pattern having an image rate of 1% was continuosly produced under N/N environment (23° C. and 45%) by modified iPSiO SPC220 filled with 100 g of a toner (developer) an external additive was added to. After 50 and 4,000 images were produced, a toner on the developing roller while a blank image was being produced was suctioned to measure a charge quantity with an electrometer.

Good: An absolute value of difference if charge quantity is from 0 to less than 10 μC/g Fair: An absolute value of difference if charge quantity is from 10 to less than 15 μC/g Poor: An absolute value of difference if charge quantity is from 10 to not less than 15 μC/g <Synthesis of Amorphous Polyester>

(Polyester 1)

In a reactor vessel including a cooling pipe, a stirrer and a nitrogen inlet pipe, 1195 parts of an adduct of bisphenol A with 2 moles of ethyleneoxide, 2765 parts of an adduct of bisphenol A with 3 moles of propyleneoxide, 900 parts terephthalic acid, 200 parts of adipic acid and 10 parts of dibutyltinoxide were reacted with each other for 8 hrs at a normal pressure and 230° C. Further, after the mixture was depressurized to 10 to 15 mm Hg and reacted for 5 hrs, 220 parts of trimellitic acid anhydride were added thereto and the mixture was reacted for 2 hrs at a normal pressure and 180° C. to prepare a [polyester 1]. The [polyester 1] had a number-average molecular weight of 2,500, a weight-average molecular weight of 6,500, a Tg of 47° C. and an acid value of 18.

(Polyester 2)

In a reactor vessel including a cooling pipe, a stirrer and a nitrogen inlet pipe, 264 parts of an adduct of bisphenol A with 2 moles of ethyleneoxide, 523 parts of an adduct of bisphenol A with 2 moles of propyleneoxide, 123 parts terephthalic acid, 173 parts of adipic acid and 1 part of dibutyltinoxide were reacted with each other for 8 hrs at a normal pressure and 230° C. Further, after the mixture was depressurized to 10 to 15 mm Hg and reacted for 8 hrs, 26 parts of trimellitic acid anhydride were added thereto and the mixture was reacted for 2 hrs at a normal pressure and 180° C. to prepare a [polyester 2]. The [polyester 2] had a number-average molecular weight of 4,000, a weight-average molecular weight of 47,000, a Tg of 65° C. and an acid value of 12.

<Synthesis of Crystalline Polyester>

(Polyester 3)

In a reactor vessel including a cooling pipe, a stirrer and a nitrogen inlet pipe, 500 parts of 1,6-hexanediol, 500 parts of succinic acid and 2.5 parts of dibutyltinoxide were reacted with each other for 8 hrs at a normal pressure and 200° C. Further, the mixture was depressurized to 10 to 15 mm Hg and reacted for 1 hr to prepare a [polyester 3]. The [polyester 3] had an endothermic peak at 65° C. when measured by DSC.

<Synthesis of Prepolymer>

In a reactor vessel including a cooling pipe, a stirrer and a nitrogen inlet pipe, 366 parts of 1,2-propyleneglycol, 566 parts of terephthalic acid, 44 parts of trimellitic acid anhydride and 6 parts of titanium tetrabutoxide were mixed and reacted for 8 hrs at a normal pressure and 230° C. Further, after the mixture was depressurized to 10 to 15 mm Hg and reacted for 5 hrs to prepare an [intermediate polyester 1]. The [intermediate polyester 1] had a number-average molecular weight of 3,200, a weight-average molecular weight of 12,000 and a Tg of 55° C.

Next, in a reactor vessel including a cooling pipe, a stirrer and a nitrogen inlet pipe, 420 parts of the [intermediate polyester 1], 80 parts of isophoronediisocyanate and 500 parts of ethyl acetate were reacted for 5 hrs at 100° C. to prepare a [prepolymer]. The [prepolymer] included a free isocyanate in an amount of 1.34% by weight.

<Preparation of Resin Particle Dispersion>

(Vinyl Copolymer Resin Particle V-1)

In a reactor vessel including a cooling pipe, a stirrer and a nitrogen inlet pipe, 1.6 parts of dodecyl sodium sulfate and 492 parts of ion-exchanged water were placed and heated to have a temperature of 80° C. A solution in which 2.5 parts of potassium peroxodisulfate were dissolved in 100 parts of ion-exchanged water was added to the mixture. Then, 15 min later, a mixed liquid including 200 parts of styrene monomer and 3.5 parts of n-octylmercaptan was dropped in the mixture for 90 min, and the mixture was kept at 80° C. for 60 min. Then, the mixture was cooled to prepare a dispersion of [vinyl copolymer resin particle V-1]. The dispersion had a solid content concentration of 25%. The particles had a volume-average particle diameter of 130 nm. A small amount of the dispersion was placed on a petri dish and a dispersion medium was vapored to obtain a solid content having a number-average molecular weight of 11,000, a weight-average molecular weight of 18,000 and a Tg of 83° C.

(Vinyl Copolymer Resin Particle V-2)

In a reactor vessel including a cooling pipe, a stirrer and a nitrogen inlet pipe, 2.0 parts of dodecyl sodium sulfate and 492 parts of ion-exchanged water were placed and heated to have a temperature of 80° C. A solution in which 2.5 parts of potassium peroxodisulfate were dissolved in 100 parts of ion-exchanged water was added to the mixture. Then, 15 min later, a mixed liquid including 170 parts of styrene monomer, 30 parts of n-butylacrylate and 3.5 parts of n-octylmercaptan was dropped in the mixture for 90 min, and the mixture was kept at 80° C. for 60 min. Then, the mixture was cooled to prepare a dispersion of [vinyl copolymer resin particle V-2]. The dispersion had a solid content concentration of 25%. The particles had a volume-average particle diameter of 90 nm. A small amount of the dispersion was placed on a petri dish and a dispersion medium was vapored to obtain a solid content having a number-average molecular weight of 18,000, a weight-average molecular weight of 35,000 and a Tg of 66° C.

<Synthesis of Masterbatch>

(Forty) 40 parts of carbon black REGAL 400R from Cabot Corp., 60 parts of a binder resin, i.e., a polyester resin RS-801 having an acid value of 10, a Mw of 20,000 and a Tg of 64° C. and 30 parts of water were mixed by a HENSCHEL mixer to prepare a water-logged pigment agglomerate. This was kneaded by a two-roll mil having a surface temperature of 130° C. for 45 min, extended upon application of pressure, cooled and pulverized by a pulverizer to prepare a [masterbatch 1] having a particle diameter of 1 mm.

<Preparation of Ester Wax>

(Synthesis of [Ester Wax 1])

In a four-neck flask reactor equipped with a Gym Rohto refluxer and a Dean-Stark water separator, 1740 parts of benzene, 1300 parts of a mixture of behenic acid and stearic acid as a long-chain alkyl carboxylic acid component, 1200 parts of a mixture of behenyl alcohol and stearyl alcohol as a long-chain alkyl alcohol component, and further 120 parts of p-toluenesulfonic acid were fully stirred and dissolved. The mixture was refluxed for 5 hrs and a valve of the water separator was opened such that the mixed was subjected to azeotropic distillation. After the azeotropic distillation, the mixture was fully washed with sodium hydrogen carbonate and dried to distil benzene. The resultant product was recrystallized, washed and refined to prepare a [ester wax 1] having an average number of carbons of 41 when measured by GPC and a melting of 70° C. when measured by DSC.

(Synthesis of Ester Wax 2)

The procedure for preparation of the [ester wax 1] was repeated except for replacing the long-chain alkyl carboxylic acid component with 1400 parts of a mixture of montanic acid and cerotic acid to prepare a [ester wax 2] having an average number of carbons of 46 when measured by GPC and a melting of 75° C. when measured by DSC.

(Synthesis of Ester Wax 3)

The procedure for preparation of the [ester wax 1] was repeated except for replacing the long-chain alkyl carboxylic acid component with 1300 parts of a mixture of stearic acid and palmitic acid and the long-chain alkyl alcohol component with 1200 parts of a mixture of behenyl alcohol and cetyl alcohol to prepare a [ester wax 3] having an average number of carbons of 38 when measured by GPC and a melting of 68° C. when measured by DSC.

(Synthesis of Ester Wax 4)

The procedure for preparation of the [ester wax 1] was repeated except for replacing the long-chain alkyl carboxylic acid component with 1300 parts of a mixture of palmitic acid and arachidic acid and the long-chain alkyl alcohol component with 1200 parts of a mixture of cetyl alcohol and octyldodecanol to prepare a [ester wax 4] having an average number of carbons of 36 when measured by GPC and a melting of 65° C. when measured by DSC.

(Synthesis of Ester Wax 5)

The procedure for preparation of the [ester wax 1] was repeated except for replacing the long-chain alkyl carboxylic acid component with 1400 parts of a mixture of montanic acid and cerotic acid and the long-chain alkyl alcohol component with 1200 parts of a mixture of behenyl alcohol and octyldodecanol to prepare a [ester wax 5] having an average number of carbons of 47 when measured by GPC and a melting of 77° C. when measured by DSC.

(Synthesis of Ester Wax 6)

The procedure for preparation of the [ester wax 1] was repeated except for replacing the long-chain alkyl carboxylic acid component with 1300 parts of a mixture of palmitic acid and stearic acid and the long-chain alkyl alcohol component with 1200 parts of a mixture of cetyl alcohol and stearic alcohol to prepare a [ester wax 5] having an average number of carbons of 34 when measured by GPC and a melting of 62° C. when measured by DSC.

Example 1

Preparation of Oil Phase

In a reaction vessel including a stirrer and a thermometer, 12 parts of the [polyester 1], 6 parts of [polyester 3], 14 parts of [ester wax 1], and 96 parts of ethylacetate were mixed. The mixture was heated to have a temperature of 80° C. while stirred. After the temperature of 80° C. was maintained for 5 hrs, the mixture was cooled to have a temperature of 30° C. in an hour. Then, 35 parts of the [masterbatch 1] was added to the mixture and mixed for 1 hr. The mixture was transferred into another vessel, and dispersed by a beads mill (Ultra Visco Mill from IMECS CO., LTD.) for 3 passes at a liquid feeding speed of 1 kg/hr and a peripheral disc speed of 6 m/sec using zirconia beads having diameter of 0.5 mm for 80% by volume to prepare a [material solution 1]. Next, 74.1 parts of ethylacetate solution of [polyester 1] having a concentration of 70%, 21.6 parts of [polyester 2] and 21.5 parts of ethylacetate were added to 81.3 parts of the [material solution 1], and the mixture was stirred by THREE-ONE MOTOR for 2 hrs to prepare an [oil phase 1]. Ethylacetate was added to the [oil phase 1] at 130° C. for 30 min to have a solid content concentration of 49%.

<Preparation of Aqueous Phase 1>

Four hundred seventy two (472) parts of ion-exchange water, 81 parts an aqueous solution of sodium dodecyldiphenyletherdisulfonate having a concentration of 50% (ELEMINOL MON-7 from Sanyo Chemical Industries, Ltd.), 67 parts of an aqueous solution of carboxymethylcellulose having a concentration of 1% and 54 parts of ethyl acetate were mixed and stirred to prepare a lacteous liquid, i.e., an [aqueous phase 1].

<Emulsification Process>

A total amount of the [oil phase 1] and 28.5 parts of the [prepolymer] were mixed by the TK-type homomixer from Tokushu Kika Kogyo Co., Ltd. at 5,000 rpm for 1 min. Then, 321 parts of the [aqueous phase 1] were added to the mixture and mixed by the TK-type homomixer at from 8,000 to 13,000 rpm for 20 min to prepare a [core particle slurry 1].

<Shell Process (Resin Particle Application to Core Particle Process)>

While the [core particle slurry 1] was stirred at 200 rpm by THREE-ONE MOTOR, 21.4 parts of the [vinyl copolymer resin particle V-2] were dropped therein for 5 min, and further stirred for 30 min. Then, a sample of the slurry was diluted with 10 times water and centrifuged by a centrifugal separator. Base toner particles settled down on the bottom of a test tube and a supernatant liquid was almost clear. Thus, a [shelled slurry 1] was prepared.

<De-Solvent>

The [shelled slurry 1] was placed in a vessel including a stirrer and a thermometer, a solvent was removed therefrom at 30° C. for 8 hrs to prepare a [dispersion slurry 1].

<Washing and Drying>

(1) After the [dispersion slurry 1] was filtered under reduced pressure to prepare a filtered cake, 100 parts of ion-exchange water were added to the filtered cake and mixed by the TK-type homomixer at 12,000 rpm for 10 min, and the mixture was filtered.

(2) Further, 900 parts of ion-exchange water were added to the filtered cake and mixed by the TK-type homomixer at 12,000 rpm for 30 min upon application of ultrasonic vibration, and the mixture was filtered under reduced pressure. This ultrasonic alkaline washing was repeated until the slurry has a conductivity not greater than 10 μC/cm.

(3) Further, hydrochloric acid having a concentration of 10% was added to the filtered cake and mixed by the TK-type homomixer at 12,000 rpm for 30 min until the slurry has a pH of 4.

(4) Further, 100 parts of ion-exchange water were added to the filtered cake and mixed by the TK-type homomixer at 12,000 rpm for 10 min, and the mixture was filtered. This operation was repeated until the slurry has a conductivity not greater than 10 μC/cm to prepare a [filtered cake 1]. The remaining [dispersion slurry 1] was washed in the same way to prepare another [filtered cake 1] to be added thereto.

Then, the [filtered cake 1] was dried at 45° C. for 48 hrs by a ventilation drier and sifted by a mesh having an opening of 75 μm to prepare a [base toner 1]. Fifty (50) parts of the [base toner 1], 1 part of hydrophobic silica having a primary particle diameter of 30 nm and 0.5 parts of hydrophobic silica having a primary particle diameter of 10 nm were mixed in HENSCHEL mixer to prepare a [developer 1].

Example 2

Preparation of Oil Phase

In a reaction vessel including a stirrer and a thermometer, 12 parts of the [polyester 1], 6 parts of [polyester 3], 14 parts of [ester wax 1], and 96 parts of ethylacetate were mixed. The mixture was heated to have a temperature of 80° C. while stirred. After the temperature of 80° C. was maintained for 5 hrs, the mixture was cooled to have a temperature of 30° C. in an hour. Then, 35 parts of the [masterbatch 1] was added to the mixture and mixed for 1 hr. The mixture was transferred into another vessel, and dispersed by a beads mill (Ultra Visco Mill from IMECS CO., LTD.) for 3 passes at a liquid feeding speed of 1 kg/hr and a peripheral disc speed of 6 msec using zirconia beads having diameter of 0.5 mm for 80% by volume to prepare a [material solution 2]. Next, 84.4 parts of ethylacetate solution of [polyester 1] having a concentration of 70% were added to 81.3 parts of the [material solution 2], and the mixture was stirred by THREE-ONE MOTOR for 2 hrs to prepare an [oil phase 2]. Ethylacetate was added to the [oil phase 2] at 130° C. for 30 min to have a solid content concentration of 50%.

<Emulsification Process>

A total amount of the [oil phase 2] and 28.5 parts of the [prepolymer] were mixed by the TK-type homomixer from Tokushu Kika Kogyo Co., Ltd. at 5,000 rpm for 1 min. Then, 321 parts of the [aqueous phase 1] were added to the mixture and mixed by the TK-type homomixer at from 8,000 to 13,000 rpm for 2 min to prepare a [core particle slurry 2].

The other processes were the same as those in Example 1 to prepare a [developer 2].

Example 3

Preparation of Oil Phase

In a reaction vessel including a stirrer and a thermometer, 13 parts of the [polyester 1], 6 parts of [polyester 3], 13 parts of [ester wax 1], and 96 parts of ethylacetate were mixed. The mixture was heated to have a temperature of 80° C. while stirred. After the temperature of 80° C. was maintained for 5 hrs, the mixture was cooled to have a temperature of 30° C. in an hour. Then, 35 parts of the [masterbatch 1] was added to the mixture and mixed for 1 hr. The mixture was transferred into another vessel, and dispersed by a beads mill (Ultra Visco Mill from IMECS CO., LTD.) for 3 passes at a liquid feeding speed of 1 kg/hr and a peripheral disc speed of 6 msec using zirconia beads having diameter of 0.5 mm for 80% by volume to prepare a [material solution 3]. Next, 74.1 parts of ethylacetate solution of [polyester 1] having a concentration of 70%, 21.6 parts of [polyester 2] and 21.5 parts of ethylacetate were added to 81.3 parts of the [material solution 3], and the mixture was stirred by THREE-ONE MOTOR for 2 hrs to prepare an [oil phase 3]. Ethylacetate was added to the [oil phase 3] at 130° C. for 30 min to have a solid content concentration of 49%.

The other processes were the same as those in Example 1 to prepare a [developer 3].

Example 4

Preparation of Oil Phase

In a reaction vessel including a stirrer and a thermometer, 13 parts of the [polyester 1], 6 parts of [polyester 3], 13 parts of [ester wax 1], and 96 parts of ethylacetate were mixed. The mixture was heated to have a temperature of 80° C. while stirred. After the temperature of 80° C. was maintained for 5 hrs, the mixture was cooled to have a temperature of 30° C. in an hour. Then, 35 parts of the [masterbatch 1] was added to the mixture and mixed for 1 hr. The mixture was transferred into another vessel, and dispersed by a beads mill (Ultra Visco Mill from IMECS CO., LTD.) for 3 passes at a liquid feeding speed of 1 kg/hr and a peripheral disc speed of 6 m/sec using zirconia beads having diameter of 0.5 mm for 80% by volume to prepare a [material solution 4]. Next, 84.4 parts of ethylacetate solution of [polyester 1] having a concentration of 70% were added to 81.3 parts of the [material solution 4], and the mixture was stirred by THREE-ONE MOTOR for 2 hrs to prepare an [oil phase 4]. Ethylacetate was added to the [oil phase 1] at 130° C. for 30 min to have a solid content concentration of 50%.

The other processes were the same as those in Example 2 to prepare a [developer 4].

Example 5

The procedure for preparation of the [developer 2] in Example 2 was repeated except for replacing the [vinyl copolymer resin particle V-2] with the [vinyl copolymer resin particle V-1] to prepare a [developer 5].

Example 6

The procedure for preparation of the [developer 2] in Example 2 was repeated except for replacing the [ester wax 1] with the [ester wax 2] to prepare a [developer 6].

Example 7

The procedure for preparation of the [developer 2] in Example 2 was repeated except for replacing the [ester wax 1] with the [ester wax 3] to prepare a [developer 7].

Example 8

The procedure for preparation of the [developer 2] in Example 2 was repeated except for replacing the [ester wax 1] with the [ester wax 4] to prepare a [developer 8].

Comparative Example 1

Preparation of Oil Phase

In a reaction vessel including a stirrer and a thermometer, 12 parts of the [polyester 1], 6 parts of [polyester 3], 14 parts of [ester wax 1], and 96 parts of ethylacetate were mixed. The mixture was heated to have a temperature of 80° C. while stirred. After the temperature of 80° C. was maintained for 5 hrs, the mixture was cooled to have a temperature of 30° C. in an hour. Then, 35 parts of the [masterbatch 1] was added to the mixture and mixed for 1 hr. The mixture was transferred into another vessel, and dispersed by a beads mill (Ultra Visco Mill from IMECS CO., LTD.) for 2 passes at a liquid feeding speed of 1 kg/hr and a peripheral disc speed of 6 msec using zirconia beads having diameter of 0.5 mm for 80% by volume to prepare a [material solution R1]. Next, 74.1 parts of ethylacetate solution of [polyester 1] having a concentration of 70%, 21.6 parts of [polyester 2] and 21.5 parts of ethylacetate were added to 81.3 parts of the [material solution R1], and the mixture was stirred by THREE-ONE MOTOR for 2 hrs to prepare an [oil phase R1]. Ethylacetate was added to the [oil phase R1] at 130° C. for 30 min to have a solid content concentration of 49%. The other processes were the same as those in Example 1 to prepare a [developer R1].

Comparative Example 2

Preparation of Oil Phase

In a reaction vessel including a stirrer and a thermometer, 12 parts of the [polyester 1], 6 parts of [polyester 3], 14 parts of [ester wax 1], and 96 parts of ethylacetate were mixed. The mixture was heated to have a temperature of 80° C. while stirred. After the temperature of 80° C. was maintained for 5 hrs, the mixture was cooled to have a temperature of 30° C. in an hour. Then, 35 parts of the [masterbatch 1] was added to the mixture and mixed for 1 hr. The mixture was transferred into another vessel, and dispersed by a beads mill (Ultra Visco Mill from IMECS CO., LTD.) for 6 passes at a liquid feeding speed of 1 kg/hr and a peripheral disc speed of 6 m/sec using zirconia beads having diameter of 0.5 mm for 80% by volume to prepare a [material solution R2]. Next, 84.4 parts of ethylacetate solution of [polyester 1] having a concentration of 70% were added to 81.3 parts of the [material solution 2], and the mixture was stirred by THREE-ONE MOTOR for 2 hrs to prepare an [oil phase R2]. Ethylacetate was added to the [oil phase R2] at 130° C. for 30 min to have a solid content concentration of 50%.

The other processes were the same as those in Example 2 to prepare a [developer R2].

Comparative Example 3

Preparation of Oil Phase

In a reaction vessel including a stirrer and a thermometer, 14 parts of the [polyester 1], 6 parts of [polyester 3], 12 parts of [ester wax 1], and 96 parts of ethylacetate were mixed. The mixture was heated to have a temperature of 80° C. while stirred. After the temperature of 80° C. was maintained for 5 hrs, the mixture was cooled to have a temperature of 30° C. in an hour. Then, 35 parts of the [masterbatch 1] was added to the mixture and mixed for 1 hr. The mixture was transferred into another vessel, and dispersed by a beads mill (Ultra Visco Mill from IMECS CO., LTD.) for 3 passes at a liquid feeding speed of 1 kg/hr and a peripheral disc speed of 6 m/sec using zirconia beads having diameter of 0.5 mm for 80% by volume to prepare a [material solution R3]. Next, 74.1 parts of ethylacetate solution of [polyester 1] having a concentration of 70%, 21.6 parts of [polyester 2] and 21.5 parts of ethylacetate were added to 81.3 parts of the [material solution R3], and the mixture was stirred by THREE-ONE MOTOR for 2 hrs to prepare an [oil phase R3]. Ethylacetate was added to the [oil phase R3] at 130° C. for 30 min to have a solid content concentration of 49%.

The other processes were the same as those in Example 1 to prepare a [developer R3].

Comparative Example 4

Preparation of Oil Phase

In a reaction vessel including a stirrer and a thermometer, 10 parts of the [polyester 1], 6 parts of [polyester 3], 16 parts of [ester wax 1], and 96 parts of ethylacetate were mixed. The mixture was heated to have a temperature of 80° C. while stirred. After the temperature of 80° C. was maintained for 5 hrs, the mixture was cooled to have a temperature of 30° C. in an hour. Then, 35 parts of the [masterbatch 1] was added to the mixture and mixed for 1 hr. The mixture was transferred into another vessel, and dispersed by a beads mill (Ultra Visco Mill from IMECS CO., LTD.) for 3 passes at a liquid feeding speed of 1 kg/hr and a peripheral disc speed of 6 m/sec using zirconia beads having diameter of 0.5 mm for 80% by volume to prepare a [material solution R4]. Next, 74.1 parts of ethylacetate solution of [polyester 1] having a concentration of 70%, 21.6 parts of [polyester 2] and 21.5 parts of ethylacetate were added to 81.3 parts of the [material solution R4], and the mixture was stirred by THREE-ONE MOTOR for 2 hrs to prepare an [oil phase R4]. Ethylacetate was added to the [oil phase R3] at 130° C. for 30 min to have a solid content concentration of 49%.

The other processes were the same as those in Example 1 to prepare a [developer R4].

Comparative Example 5

The procedure for preparation of the [developer 2] in Example 2 was repeated except for replacing the [ester wax 1] with the [ester wax 5] to prepare a [developer R5].

Comparative Example 6

The procedure for preparation of the [developer 2] in Example 2 was repeated except for replacing the [ester wax 1] with the [ester wax 6] to prepare a [developer R6].

Comparative Example 7

The procedure for preparation of the [developer 1] in Example 1 was repeated except for not performing the <Shell Process (Resin Particle Application to Core Particle Process)> to prepare a [developer R7].

Properties and evaluation results of the developers prepared in Examples and Comparative Examples are shown in Tables 1-1 to 1-3.

TABLE 1-1

| | Developer | Toner Particle Diameter | | | Shape |
|---|---|---|---|---|---|
| | | Dv | Dn | Dv/Dn | Circularity |
| Example 1 | 1 | 6.4 | 5.7 | 1.12 | 0.980 |
| Example 2 | 2 | 6.5 | 5.8 | 1.12 | 0.985 |
| Example 3 | 3 | 6.3 | 5.6 | 1.13 | 0.982 |
| Example 4 | 4 | 6.0 | 5.4 | 1.11 | 0.984 |
| Example 5 | 5 | 6.6 | 5.8 | 1.14 | 0.984 |
| Example 6 | 6 | 6.4 | 5.7 | 1.12 | 0.981 |
| Example 7 | 7 | 6.3 | 5.5 | 1.15 | 0.979 |
| Example 8 | 8 | 6.5 | 5.7 | 1.14 | 0.982 |
| Comparative Example 1 | R1 | 6.3 | 5.6 | 1.13 | 0.982 |
| Comparative Example 2 | R2 | 6.0 | 5.3 | 1.13 | 0.983 |
| Comparative Example 3 | R3 | 6.5 | 5.7 | 1.14 | 0.981 |
| Comparative Example 4 | R4 | 6.4 | 5.7 | 1.12 | 0.984 |
| Comparative Example 5 | R5 | 6.4 | 5.6 | 1.14 | 0.980 |
| Comparative Example 6 | R6 | 6.3 | 5.5 | 1.15 | 0.979 |
| Comparative Example 7 | R7 | 6.2 | 5.5 | 1.13 | 0.981 |

TABLE 1-2

| | Developer | DSC | | |
|---|---|---|---|---|
| | | ΔH1 (mJ/mg) | ΔH2 (mJ/mg) | ΔH2/ΔH1 |
| Example 1 | 1 | 11.5 | 9.2 | 0.80 |
| Example 2 | 2 | 11.1 | 8.8 | 0.79 |
| Example 3 | 3 | 10.5 | 8.5 | 0.81 |
| Example 4 | 4 | 10.1 | 8.5 | 0.84 |
| Example 5 | 5 | 12.0 | 10.3 | 0.86 |
| Example 6 | 6 | 10.9 | 8.8 | 0.81 |
| Example 7 | 7 | 11.4 | 8.9 | 0.78 |
| Example 8 | 8 | 11.2 | 9.9 | 0.88 |
| Comparative Example 1 | R1 | 12.0 | 7.1 | 0.59 |
| Comparative Example 2 | R2 | 11.3 | 10.3 | 0.91 |
| Comparative Example 3 | R3 | 9.8 | 7.5 | 0.77 |
| Comparative Example 4 | R4 | 12.3 | 11.0 | 0.89 |
| Comparative Example 5 | R5 | 11.5 | 9.4 | 0.82 |
| Comparative Example 6 | R6 | 10.8 | 9.2 | 0.85 |
| Comparative Example 7 | R7 | 11.7 | 9.4 | 0.80 |

TABLE 1-3

| | | Evaluation Result | | | |
|---|---|---|---|---|---|
| | Developer | Toner Surface | Fixability | Heat-resistant storageability | Developability |
| Example 1 | 1 | Good | Good | Good | Good |
| Example 2 | 2 | Good | Excellent | Good | Good |
| Example 3 | 3 | Good | Good | Excellent | Good |
| Example 4 | 4 | Good | Excellent | Excellent | Good |
| Example 5 | 5 | Good | Good | Excellent | Good |
| Example 6 | 6 | Good | Good | Excellent | Good |
| Example 7 | 7 | Good | Excellent | Good | Good |
| Example 8 | 8 | Good | Excellent | Good | Good |
| Comparative Example 1 | R1 | Good | Poor | Good | Good |

TABLE 1-3-continued

| | Developer | Evaluation Result | | | |
|---|---|---|---|---|---|
| | | Toner Surface | Fixability | Heat-resistant storageability | Developability |
| Comparative Example 2 | R2 | Good | Good | Fair | Good |
| Comparative Example 3 | R3 | Good | Fair | Good | Good |
| Comparative Example 4 | R4 | Good | Good | Poor | Poor |
| Comparative Example 5 | R5 | Good | Poor | Good | Good |
| Comparative Example 6 | R6 | Good | Excellent | Poor | Poor |
| Comparative Example 7 | R7 | Poor | Good | Poor | Poor |

Having now fully described the invention, it will be apparent to one of ordinary skill in the art that many changes and modifications can be made thereto without departing from the spirit and scope of the invention as set forth therein.

What is claimed is:

1. A toner, comprising:

6 to 10% by weight of a monoester wax having carbon atoms of from 36 to 46 on average as a release agent, a base, and an inorganic particulate material, wherein the toner has a DSC endothermic energy amount (ΔH1) originating from the wax of from 10 to 12 mJ/mg and a DSC endothermic energy amount (ΔH2) originating from the wax of from 0.6 to 0.9 times as much as ΔH1 when a part of the wax is separated by hexane extraction from the toner, and wherein the hexane extraction comprises:

mixing 1 g of the toner in 7 ml of n-hexane to prepare a mixture;

stirring the mixture at 120 rpm for 1 min by a pot mill to prepare a dispersion; and subjecting the dispersion to suction filtration, wherein the base comprises:

a main part comprising a resin, the release agent and a colorant, and a convex part formed of a particulate resin, overlying the main part, wherein the toner has a sea-island structure where the main part is a sea and the convex part is an island, the resin comprises a first resin, and the particulate resin is different from the first resin, and wherein the toner is prepared by a process comprising wet granulation.

2. The toner of claim 1, wherein the first resin is a polyester resin and the particulate resin is a vinyl resin.

3. The toner of claim 1, wherein the main part further comprises a modified polyester resin having a urethane and/or a urea group.

4. The toner of claim 1, wherein the main part further comprises a crystalline polyester resin.

5. A process cartridge detachable from image forming apparatus, comprising:

a latent image bearer; and an image developer containing a developer comprising the toner according to claim 1.

6. A method of preparing the toner according to claim 1, comprising:

dissolving or dispersing at least the resin, the colorant and the release agent in an organic solvent to prepare a solution or a dispersion comprising dissolved or dispersed materials;

placing the solution or the dispersion in an aqueous medium such that the dissolved or dispersed materials are suspended to prepare a core particle dispersion which is a main component;

adding a resin particle dispersion to the core particle dispersion to form a mixed dispersion in which the resin particles adhere to the surface of the core particles; and removing the organic solvent from the mixed dispersion.

7. The method of claim 6, wherein the aqueous medium comprises a surfactant.

8. The method of claim 6, further comprising:

removing a part of the organic solvent from the mixed dispersion.

9. The method of claim 6, wherein the core particle dispersion comprises an organic solvent in an amount of from 10 to 70% by weight based on total weight of the core particles.

10. The toner of claim 1, which comprises 6 to 8% by weight of the monoester wax.

11. The toner of claim 1, which comprises 6.5 to 7.5% by weight of the monoester wax.

12. The toner of claim 1, wherein the monoester wax is behenyl behenate.

13. The toner of claim 1, wherein the monoester wax is stearyl stearate.

* * * * *